US009956676B2

(12) United States Patent
Wong et al.

(10) Patent No.: US 9,956,676 B2
(45) Date of Patent: May 1, 2018

(54) TOOL WITH ROTATABLE HEAD

(71) Applicant: Techtronic Power Tools Technology Limited, Tortola (VG)

(72) Inventors: Tsz Kin Wong, Fanling (HK); Brent Gregorich, Anderson, SC (US)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 521 days.

(21) Appl. No.: 14/150,323

(22) Filed: Jan. 8, 2014

(65) Prior Publication Data

US 2014/0190715 A1 Jul. 10, 2014

Related U.S. Application Data

(60) Provisional application No. 61/750,583, filed on Jan. 9, 2013.

(51) Int. Cl.
*B25B 13/46* (2006.01)
*B25F 5/02* (2006.01)
(Continued)

(52) U.S. Cl.
CPC ..... *B25F 5/02* (2013.01); *B24B 23/04* (2013.01); *B25B 21/00* (2013.01); *B25B 23/0028* (2013.01); *B25F 3/00* (2013.01)

(58) Field of Classification Search
CPC ..... B25F 5/02; B25F 5/00; B24B 37/20
(Continued)

(56) References Cited

U.S. PATENT DOCUMENTS 2,619,132 A * 11/1952 Pierce ..... B23D 49/162 144/35.1
2,621,689 A * 12/1952 Fordon ..... B23D 51/10 30/519
(Continued)

FOREIGN PATENT DOCUMENTS

AU 2001240337 9/2001
AU 2006201841 11/2006
(Continued)

OTHER PUBLICATIONS

International Search Report and Written Opinion for Application No. PCT/CN2014/070410 dated May 14, 2014 (12 pages).
(Continued)

*Primary Examiner* — Robert Long
(74) *Attorney, Agent, or Firm* — Michael Best & Friedrich LLP

(57) ABSTRACT

An articulating head of a power tool is disclosed in the present invention, which includes a base member adapted to couple to a main body of the power tool, an articulating member pivotably connected to the base member, and a locking device coupled to the articulating member for locking an orientation of the articulating member with respect to the base member. The base member contains a first power transmission part which is capable of receiving mechanical driving power from the main body of the power tool. The articulating member contains a second power transmission part mechanically coupled to the first power transmission part. The locking device has an actuation lever rotatable about a pivot axis between a free position and a lock position.

23 Claims, 27 Drawing Sheets

(51) Int. Cl.

| | |
|---|---|
| ***B25F 3/00*** | (2006.01) |
| ***B24B 23/04*** | (2006.01) |
| ***B25B 23/00*** | (2006.01) |
| ***B25B 21/00*** | (2006.01) |

(58) Field of Classification Search
USPC ..... 173/29, 141, 213–222, 164–171
See application file for complete search history.

(56) References Cited

U.S. PATENT DOCUMENTS 2,762,407 A * 9/1956 McCord, Jr. ..... B23D 51/10 30/519
3,509,629 A * 5/1970 Fukuda ..... A61C 1/06 310/50
3,554,292 A * 1/1971 Lewis ..... E02F 3/844 172/4.5
3,616,883 A 11/1971 Sindelar
3,834,252 A 9/1974 Abell et al.
3,866,692 A * 2/1975 Stelljes ..... B23B 45/008 173/110
3,937,036 A 2/1976 Sauerwein
4,091,880 A * 5/1978 Troutner ..... A61B 17/1628 173/170
4,347,450 A * 8/1982 Colligan ..... B23B 45/003 310/50
4,522,270 A 6/1985 Kishi
4,655,103 A 4/1987 Schreiber et al.
4,759,240 A 7/1988 Lin
4,782,726 A * 11/1988 Ryder ..... B23P 19/06 81/57.24
5,069,091 A 12/1991 Bramsiepe et al.
5,129,467 A * 7/1992 Watanabe ..... B23Q 11/0046 173/217
5,149,230 A * 9/1992 Nett ..... B25B 21/00 408/125
5,239,783 A 8/1993 Matechuk
5,251,706 A * 10/1993 Evans ..... B25B 13/46 173/217
5,545,080 A 8/1996 Clowers et al.
5,568,849 A 10/1996 Sasaki et al.
5,690,545 A 11/1997 Clowers et al.
5,713,505 A * 2/1998 Huitema ..... A61B 17/07207 227/175.1
5,735,183 A 4/1998 Sasaki et al.
5,784,934 A * 7/1998 Izumisawa ..... B25B 21/00 74/417
5,815,928 A * 10/1998 Cline ..... A01D 34/90 172/13
5,817,119 A * 10/1998 Klieman ..... A61B 17/29 606/170
5,832,611 A * 11/1998 Schmitz ..... B23D 49/11 173/29
5,940,977 A * 8/1999 Moores, Jr. ..... B23D 49/11 30/392
6,102,134 A 8/2000 Alsruhe
6,173,792 B1 1/2001 Hald
6,308,599 B1 10/2001 Fu-Hui
6,316,890 B1 * 11/2001 Gmeilbauer ..... B24B 23/04 173/205
6,321,856 B1 11/2001 Alsruhe
6,324,947 B2 * 12/2001 Jarvis ..... B25B 23/0021 81/177.2
6,364,033 B1 * 4/2002 Hung ..... B25F 5/021 173/170
6,386,075 B1 5/2002 Shiao
6,397,708 B1 6/2002 Hung
6,401,301 B1 6/2002 Hung
6,405,620 B2 6/2002 Liao
6,467,556 B2 10/2002 Alsruhe
6,516,525 B2 * 2/2003 Liu ..... B23D 49/10 30/166.3
6,569,001 B2 * 5/2003 Rudolf ..... B24B 45/006 451/344
6,671,969 B2 * 1/2004 Phillips ..... B23D 49/11 30/377
6,817,424 B1 11/2004 Su et al.
6,929,074 B1 * 8/2005 Lai ..... B25B 21/00 173/178
6,938,706 B2 9/2005 Ng
6,962,523 B2 11/2005 Fraser et al.
7,024,966 B2 4/2006 Chao
7,055,622 B2 6/2006 Bone
7,156,187 B1 * 1/2007 Townsan ..... B25B 13/481 173/1
7,191,677 B2 3/2007 Barkdoll
7,207,233 B2 4/2007 Wadge
7,223,161 B2 5/2007 Kodani et al.
7,281,591 B2 10/2007 Bone
7,400,106 B2 7/2008 DeCicco et al.
7,431,188 B1 * 10/2008 Marczyk ..... A61B 17/072 227/175.1
7,458,882 B2 12/2008 Izmailov
7,487,844 B2 2/2009 DeCicco et al.
7,549,913 B2 6/2009 Weiford et al.
7,591,604 B2 9/2009 Roberts
7,673,701 B2 3/2010 Tanaka et al.
7,708,085 B2 5/2010 DeCicco et al.
7,722,444 B2 5/2010 Gallagher et al.
7,752,760 B2 * 7/2010 Baskar ..... A01G 3/053 30/210
7,779,931 B2 * 8/2010 Townsan ..... B25B 21/00 173/216
7,828,631 B1 11/2010 Herbert
7,861,796 B2 1/2011 DeCicco et al.
7,862,265 B1 * 1/2011 Clark ..... B23B 39/14 408/110
7,887,395 B2 2/2011 Weiford et al.
7,900,420 B2 * 3/2011 Pope ..... E04F 21/165 173/13
7,926,585 B2 * 4/2011 Pozgay ..... B25B 21/00 173/170
8,087,976 B2 1/2012 Gallagher et al.
8,087,977 B2 1/2012 Gallagher et al.
8,113,410 B2 * 2/2012 Hall ..... A61B 17/07207 227/176.1
8,128,250 B2 3/2012 Parrinello
8,136,257 B2 * 3/2012 Lau ..... A01G 3/053 30/216
8,205,342 B2 * 6/2012 Doumani ..... B23D 49/167 30/392
8,256,527 B2 9/2012 Wu
8,276,685 B2 10/2012 Hozumi et al.
8,292,700 B2 10/2012 Gallagher et al.
8,322,456 B2 12/2012 Pozgay et al.
8,387,717 B2 3/2013 Kildevaeld
8,485,276 B2 7/2013 Wei
8,561,717 B2 10/2013 Pozgay et al.
8,695,725 B2 * 4/2014 Lau ..... B25F 3/00 173/170
8,991,516 B2 * 3/2015 Wei ..... B25D 11/068 173/122
9,339,927 B2 * 5/2016 Xu ..... B27B 19/006
2002/0011344 A1 * 1/2002 Alsruhe ..... B25B 21/00 173/217
2003/0015066 A1 * 1/2003 Chao ..... B25B 21/00 81/57.26
2003/0095842 A1 * 5/2003 Bone ..... B25F 5/02 408/234
2003/0110645 A1 * 6/2003 Phillips ..... B23D 49/11 30/392
2004/0069512 A1 * 4/2004 Ng ..... B25F 5/02 173/216
2005/0006434 A1 * 1/2005 Wales ..... A61B 17/07207 227/180.1
2005/0034276 A1 * 2/2005 Badiali ..... B25F 5/026 16/426
2005/0184125 A1 * 8/2005 Marczyk ..... A61B 17/07207 227/176.1
2006/0096770 A1 * 5/2006 Roberts ..... B25F 5/02 173/217

(56) References Cited

U.S. PATENT DOCUMENTS

2007/0000138 A1* 1/2007 Baskar ..... A01G 3/0417 30/392
2007/0084616 A1* 4/2007 Lam ..... B25F 5/02 173/217
2007/0144752 A1* 6/2007 Pozgay ..... B25B 21/00 173/216
2007/0272060 A1* 11/2007 Schoenbeck ..... B25G 1/066 81/177.8
2008/0142351 A1 6/2008 Gallagher et al.
2009/0084826 A1* 4/2009 Shah ..... A61B 17/07207 227/178.1
2009/0148139 A1 6/2009 DeCicco et al.
2010/0001036 A1* 1/2010 Marczyk ..... A61B 17/07207 227/175.1
2011/0000693 A1* 1/2011 Fuchs ..... B25D 11/125 173/117
2011/0072946 A1* 3/2011 Bernardi ..... B25F 5/00 83/522.11
2011/0209888 A1* 9/2011 Elsworthy ..... B23B 31/1071 173/217
2011/0266014 A1* 11/2011 McRoberts ..... B25F 5/02 173/170
2011/0266758 A1* 11/2011 Sergyeyenko ..... B24B 23/04 279/106
2011/0308830 A1* 12/2011 Furusawa ..... B23Q 11/0046 173/198
2012/0037387 A1* 2/2012 Wei ..... B25D 11/068 173/46
2012/0086177 A1* 4/2012 Zhou ..... B25F 5/00 279/140
2012/0163016 A1 6/2012 Parrinello
2012/0324744 A1* 12/2012 Henrickson ..... A61B 17/144 30/394
2013/0008677 A1* 1/2013 Huifu ..... B25F 3/00 173/29
2013/0056235 A1 3/2013 Pozgay et al.
2013/0140050 A1* 6/2013 Eshleman ..... B25B 21/00 173/1
2013/0181414 A1 7/2013 Haman
2013/0199811 A1* 8/2013 Maddilate ..... B25F 5/02 173/170
2013/0213683 A1* 8/2013 Brewster ..... B23Q 11/00 173/198
2013/0213684 A1* 8/2013 Ikuta ..... B27B 19/006 173/213
2013/0284472 A1 10/2013 Kildevaeld
2014/0084552 A1* 3/2014 Zieger ..... B24B 23/022 279/141
2014/0144655 A1* 5/2014 Fuchs ..... B24B 23/04 173/46
2014/0144662 A1* 5/2014 Zhou ..... B23Q 3/14 173/213
2014/0182872 A1* 7/2014 Rubens ..... B27B 19/006 173/213
2014/0260745 A1* 9/2014 Rommel ..... B25F 5/001 74/417
2015/0042052 A1* 2/2015 Furusawa ..... B24B 23/04 279/141
2015/0069724 A1* 3/2015 Wierzchon ..... B25F 3/00 279/144
2015/0122526 A1* 5/2015 Bernardi ..... B26B 7/00 173/213
2015/0135541 A1* 5/2015 Wierzchon ..... B27B 19/006 30/276
2015/0151415 A1* 6/2015 Saitou ..... B25B 21/00 173/93
2015/0283691 A1* 10/2015 Rubens ..... B25F 5/00 173/213
2016/0184984 A1* 6/2016 Dresen ..... B24B 23/04 173/1

FOREIGN PATENT DOCUMENTS

| | | |
|---|---|---|
| CN | 1416380 | 5/2003 |
| CN | 2723086 | 9/2005 |
| CN | 1714999 | 1/2006 |
| CN | 1876323 A | 12/2006 |
| CN | 200948579 | 9/2007 |
| CN | 201353719 | 12/2009 |
| CN | 101704212 | 5/2010 |
| CN | 102069442 | 5/2011 |
| CN | 202037504 | 11/2011 |
| CN | 202185811 | 4/2012 |
| CN | 202278463 | 6/2012 |
| CN | 1876323 B | 7/2012 |
| CN | 202292325 | 7/2012 |
| DE | 20308403 | 10/2003 |
| DE | 202005011659 | 12/2005 |
| DE | 102005021153 | 11/2006 |
| DE | 102005021212 | 11/2006 |
| DE | 102008063508 | 6/2010 |
| EP | 0727281 | 10/2001 |
| EP | 1272314 | 9/2006 |
| EP | 1719581 | 11/2006 |
| EP | 1512497 | 8/2007 |
| EP | 1611997 | 8/2008 |
| EP | 1728592 | 12/2008 |
| EP | 2095907 | 9/2010 |
| EP | 2196284 | 1/2012 |
| EP | 2033738 | 7/2012 |
| GB | 2374821 | 6/2004 |
| GB | 2391501 | 6/2004 |
| WO | WO 08/033377 | 3/2008 |
| WO | 2012041211 | 4/2012 |
| WO | WO 2012/145458 | 10/2012 |
| WO | WO 2013/018514 | 2/2013 |

OTHER PUBLICATIONS

European Search Report for Application No. 14738273 dated Aug. 8, 2016 (1 page).

* cited by examiner

TOOL WITH ROTATABLE HEAD

CROSS-REFERENCE TO RELATED APPLICATION

This application claims priority to U.S. Provisional Patent Application No. 61/750,583 filed on Jan. 9, 2013, the entire contents of which are incorporated herein by reference.

BACKGROUND

The present invention relates to power tools driven by an electric motor, and more specifically, the present invention relates to oscillating power tools. Power tools utilize the rotation of an electric motor to provide useful torque for operations such as cutting.

SUMMARY

In one aspect, the invention provides an articulating power tool. The articulating power tool has a main body and a base member including a first power transmission part configured to receive mechanical driving power from the main body. The articulating power tool also includes an articulating member pivotably coupled to the base member. The articulating member includes a second power transmission part mechanically coupled to said first power transmission part. The articulating power tool also includes a locking device coupled to the articulating member for locking an orientation of the articulating member with respect to the base member. The locking device includes an actuation lever rotatable about a pivot axis between a free position and a lock position. The articulating member is configured to pivot with respect to the base member in the free position, and the articulating member is configured to be locked at one of a plurality of predetermined angles with respect to the base member in the lock position.

In another aspect, the invention provides an oscillating power tool that includes a handle portion and a head assembly having a first head portion, and a second head portion. The power tool also has a motor with a rotatable drive shaft, a tool shaft for oscillation with an arbor, and a drive mechanism for converting rotation of the drive shaft into oscillation of the tool shaft. The head assembly is detachable from the handle portion, and the first head portion is pivotable with respect to the second head portion about a pivot axis.

In another aspect, the invention provides a head attachment for a modular oscillating power tool that includes a casing, a tool shaft for oscillation with an arbor, and a forked member coupled to the tool shaft for oscillation therewith. The forked member has a contact portion that engages an eccentric member of a drive mechanism to convert rotation of the eccentric member into oscillation of the forked member and the tool shaft, and the head attachment is pivotable about a pivot axis.

In another aspect, the invention provides an articulating head of a power tool that includes a base member adapted to couple to a main body of said power tool. The base member includes a first power transmission part that is capable of receiving mechanical driving power from the main body of the power tool. The power tool also includes an articulating member pivotably connected to the base member. The articulating member includes a second power transmission part mechanically coupled to the first power transmission part. The power tool has a locking device connected to the articulating member for locking an orientation of the articulating member with respect to the base member, and the articulating member is capable of pivoting about a pivot axis with respect to said base member at a plurality of predetermined angles.

Other aspects of the invention will become apparent by consideration of the detailed description and accompanying drawings.

Figure 1:
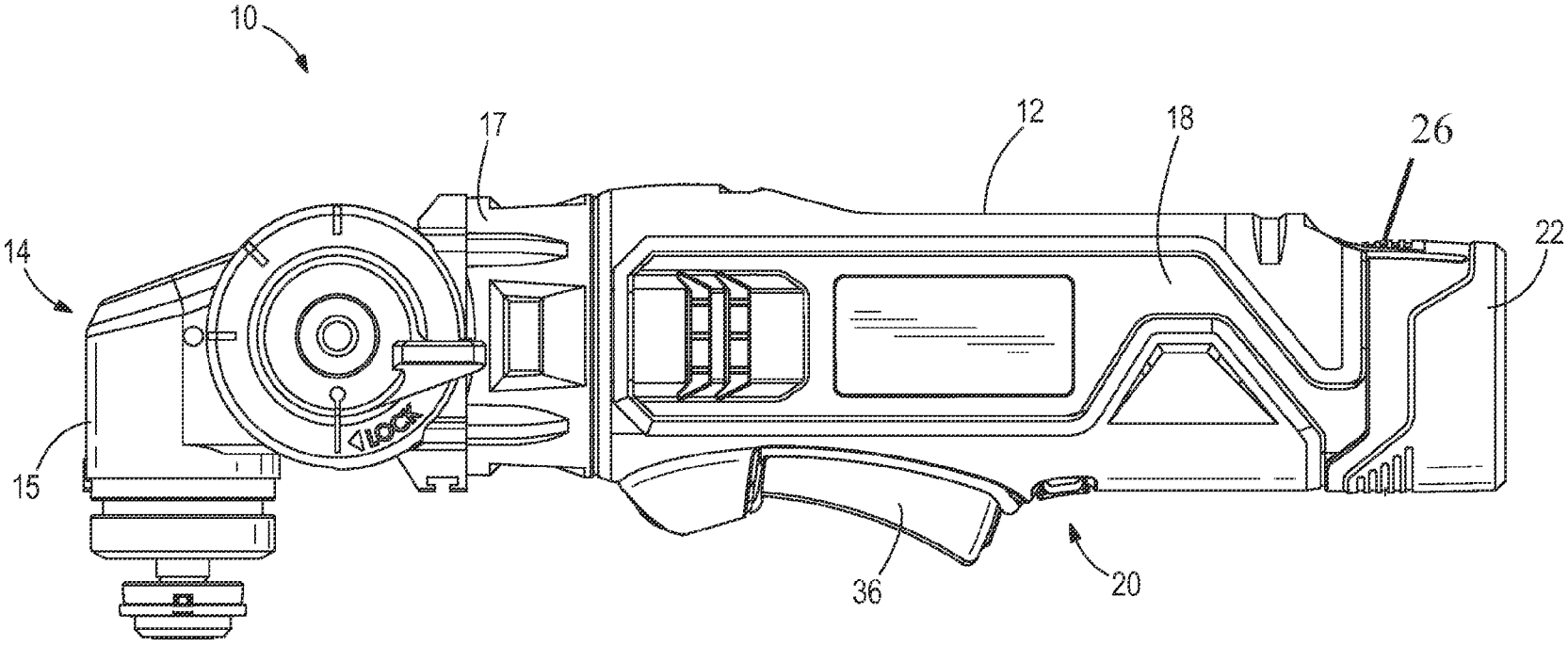
FIG. 1 is a side view of a power tool having a head and a handle according to one construction of the invention.
Figure 2:
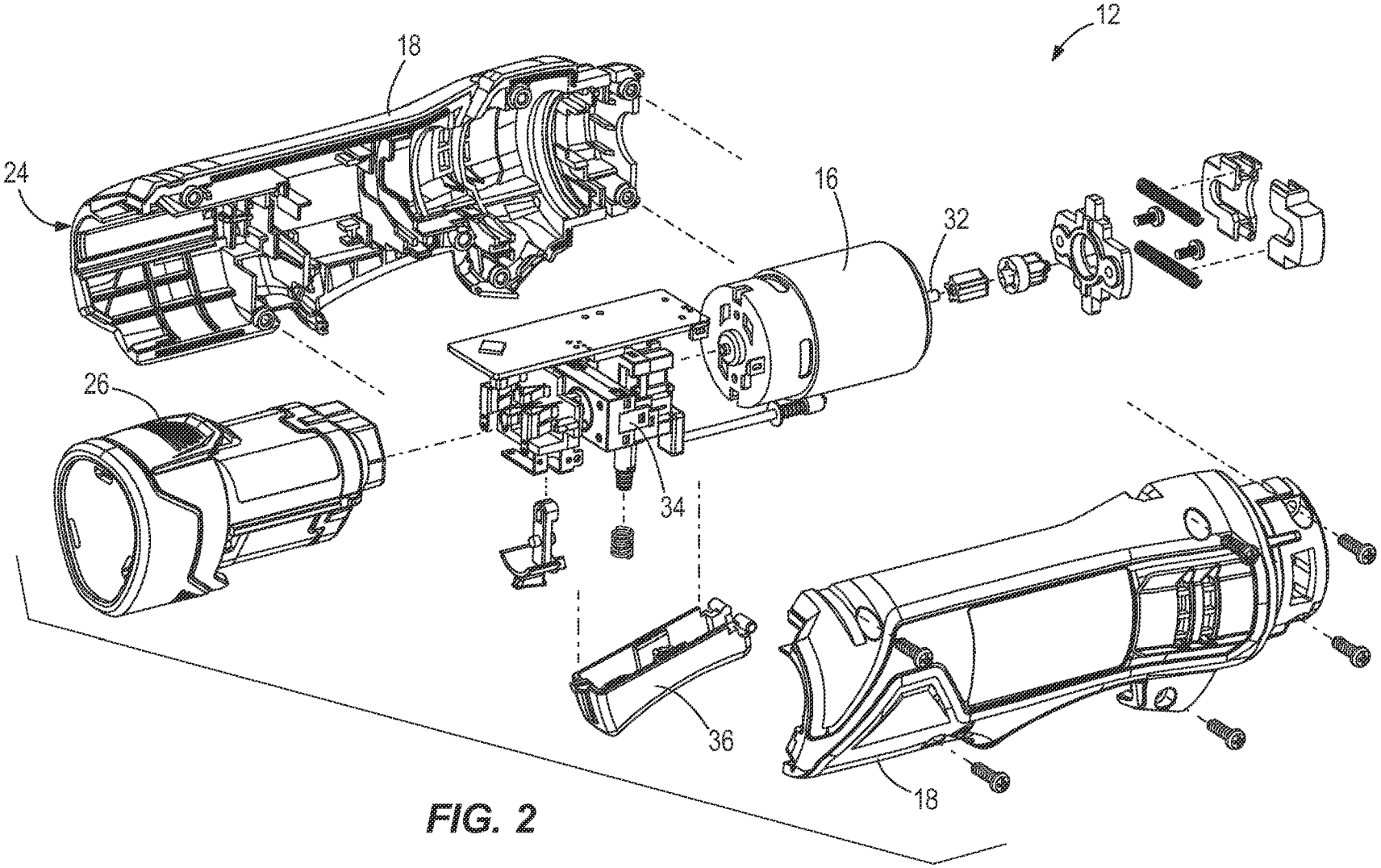
FIG. 2 is an exploded view of the handle of FIG. 1.
Figure 3:
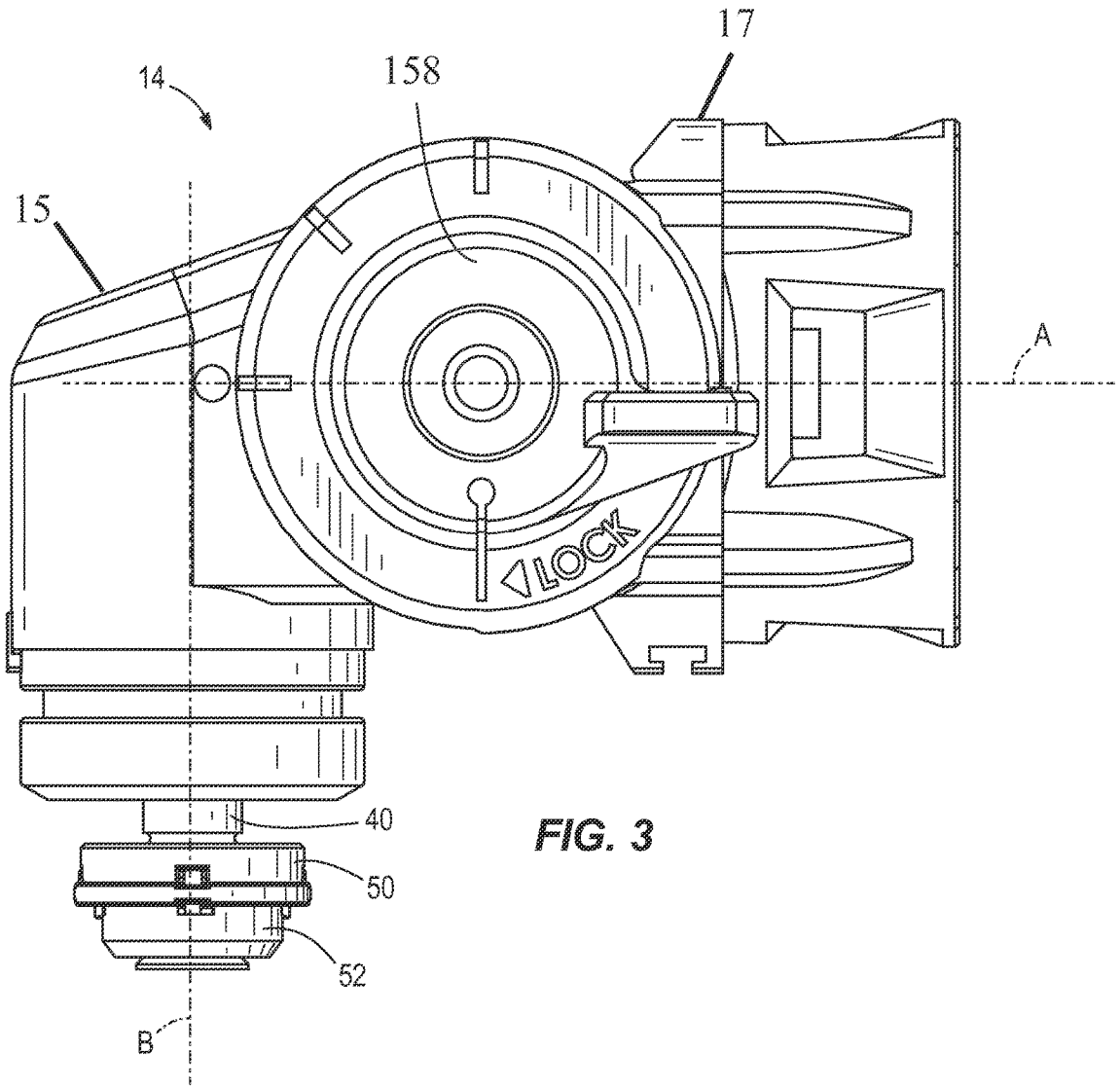
FIG. 3 is a side view of the head of FIG. 1.

Before any embodiments or constructions of the invention are explained in detail, it is to be understood that the invention is not limited in its application to the details of construction and the arrangement of components set forth in the following description or illustrated in the following drawings. The invention is capable of other embodiments and constructions and of being practiced or of being carried out in various ways. Also, it should be understood that the phraseology and terminology used herein are for the purpose of description and should not be regarded as limiting.

Detailed description FIGS. 1-9 illustrate a tool 10 according to one construction of the invention. The tool 10 includes a handle 12, or main body, and a head 14, or articulating head, coupled to the handle 12 that is driven by a motor 16 (FIG. 2) housed within the handle 12. In the illustrated construction, the head 14 is selectively attachable to and detachable from the handle 12 (FIG. 9); however, in other constructions, such as the construction shown in FIGS. 10-18, the tool 10 may be a unitary power tool and "head" and "handle" may refer generally to the head portion and the handle portion, respectively, of the unitary power tool. In the illustrated construction, the head 14 includes a first portion or pivoting portion 15 and a second portion or fixed portion 17 that pivot relative to each other. The head also includes a locking device 158 (FIG. 3), which holds the pivoting portion 15 in an operation position with respect to the fixed portion 17 and will be explained in further detail below. The head 14 is an oscillating head, or multi tool head, and the motor 16 is 12V-DC, 2.0 Amps no load current. In other constructions, other suitable motors may be employed. In yet other constructions, a variable speed or multi-speed motor may be employed.

A longitudinal axis A (FIG. 5) is defined by the handle 12 and by the fixed portion 17 of the head 14. The handle 12 includes a housing 18 and a grip portion 20 providing a surface suitable for grasping by a user to operate the tool 10. The housing 18 encloses the motor 16, which has a motor drive shaft 32 extending therefrom and arranged in line with the axis A; in other constructions, the motor drive shaft 32 is parallel to the axis A.

The handle 12 includes a removable and rechargeable battery pack 22. In the illustrated construction, the battery pack 22 is a 12-volt battery pack and includes three (3) Lithium-ion battery cells. In other constructions, the battery pack may include fewer or more battery cells such that the battery pack is a 14.4-volt battery pack, an 18-volt battery pack, or the like. Additionally or alternatively, the battery cells may have chemistries other than Lithium-ion such as, for example, Nickel Cadmium, Nickel Metal-Hydride, or the like.

The battery pack 22 is inserted into a cavity 24 (FIG. 2) in the handle housing 18 in the axial direction of axis A in order to snap into place. The battery pack 22 includes a latch 26 (FIG. 1), which can be depressed to release the battery pack 22 from the handle 12. In the illustrated construction, the battery pack 22 has a capacity of 1.5 amp hours. In other constructions, other suitable batteries and battery packs may be employed. In yet other constructions, the tool handle 12 includes a power cord 128 (FIG. 10) and is powered by a remote source of power, such as a utility source connected to the cord 128. In yet other constructions, the tool 10 may be pneumatically powered.

The handle 12 also includes a switch assembly 34 (FIG. 2) and a switch trigger 36. The switch trigger 36 is coupled with the housing 18 and is depressible to actuate the switch assembly 34 when in a depressed position. The switch assembly 34, when actuated, electrically couples the battery pack 22 and the motor 16 to run the motor 16. In other constructions, the switch assembly 34 may be actuated using a different actuator. Specifically, a two-position switch may be used to electrically couple the battery pack 22 and the motor 16, as shown in FIGS. 10 and 16*a-c*.

Figure 4:
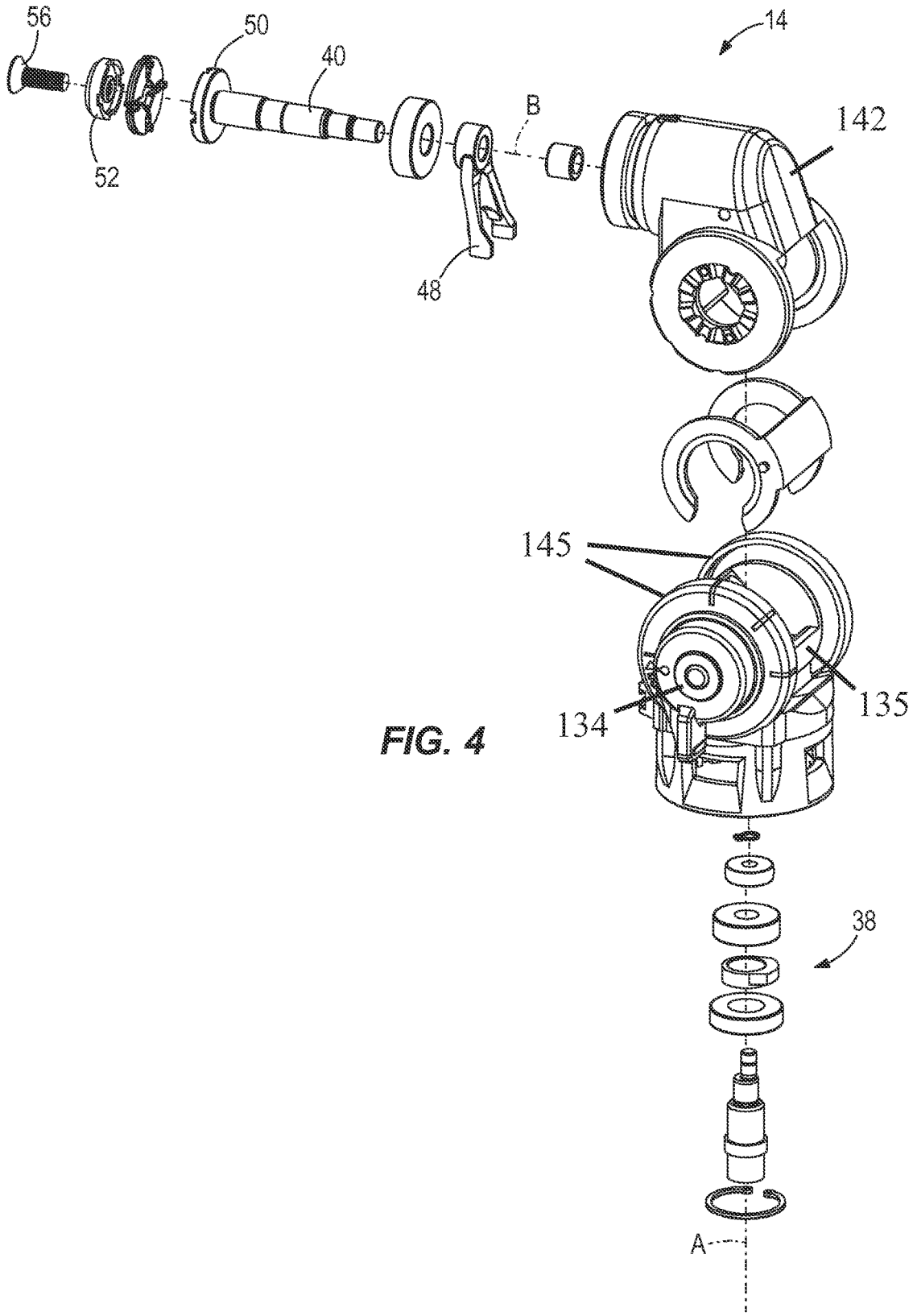
FIG. 4 is an exploded view of the head of FIG. 3.
Figure 5:
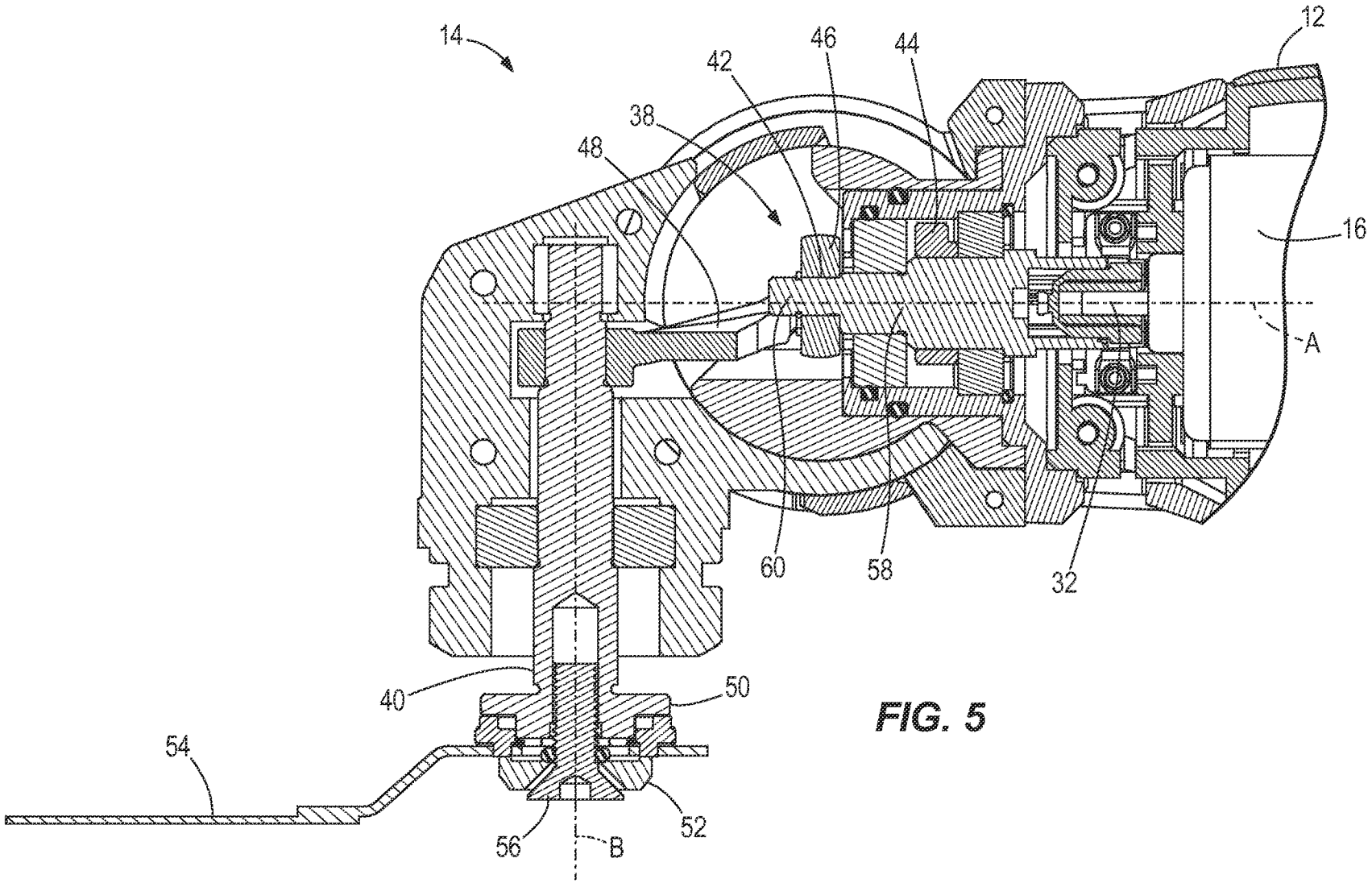
FIG. 5 is a cross section of the head of FIG. 3.

FIG. 4 is an exploded view of the head 14. The fixed portion 17 of the head 14 includes a drive mechanism 38 for converting rotary motion of the motor drive shaft 32 into oscillating motion of a tool shaft 40. As shown in FIG. 5, the drive mechanism 38 includes an eccentric shaft 42, a counter balance 44, and a ball bearing eccentric member 46. The pivotable portion 15 of the head 14 includes the tool shaft 40 and a forked member 48 coupled to the drive mechanism 38, as will be described in greater detail below. The tool shaft 40 defines a longitudinal axis B substantially perpendicular to the axis A.

Figure 6:
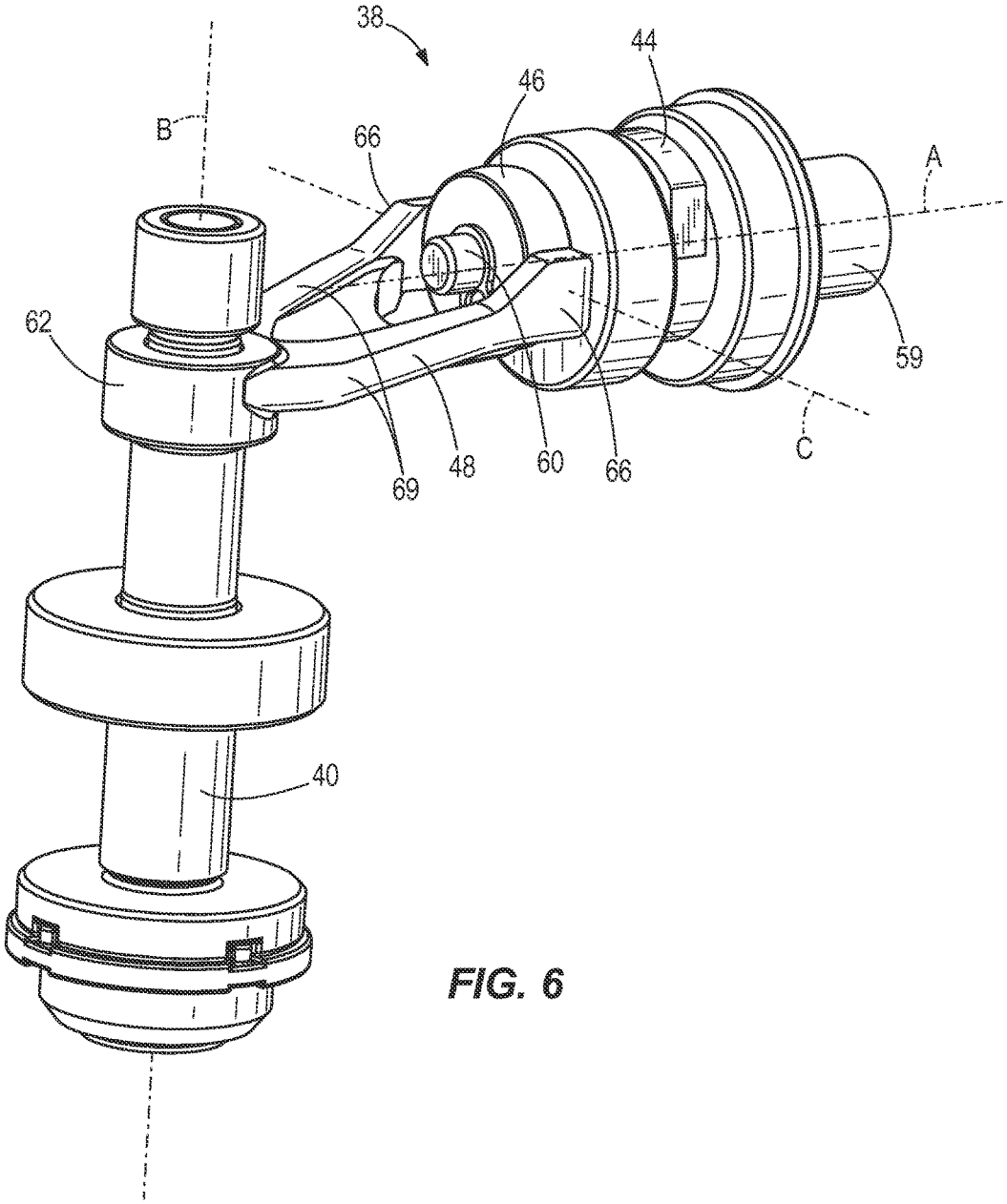
FIG. 6 is a perspective view of a drive mechanism portion of the power tool shown in FIG. 1.

FIG. 6 illustrates the drive mechanism 38 and tool shaft 40 in isolation, with the remainder of the tool 10 removed from view. The eccentric shaft 42 includes an eccentric portion 60 that is not centered about the axis A. The counter balance 44 is press fit on a centered portion 58 of the eccentric shaft 42, and the ball bearing eccentric member 46 is press fit on the eccentric portion 60 of the eccentric shaft 42. The counter balance 44 counters the off-center rotation of the eccentric portion 60 and the ball bearing eccentric member 46 to reduce vibrations caused by the eccentric rotation thereof.

The forked member 48 is coupled to the tool shaft 40 by a sleeve 62 and includes two arms 69. The arms 69 are positioned adjacent generally opposite sides of the ball bearing eccentric member 46, and each arm 69 includes a contact portion 66 that engages an outer circumferential surface of the ball bearing eccentric member 46. As the eccentric member 46 rotates and wobbles about the axis A, the contact portions 66 engage the eccentric member 46 in an alternating fashion, the eccentric member 46 pushing each contact portion 66 in an alternating clockwise and counterclockwise direction about the axis B. Thus, the forked member 48 wobbles and oscillates about the axis B to convert the eccentric rotary motion of the ball bearing eccentric member 46 about the axis A into oscillating motion of the oscillating tool shaft 40 about the axis B.

As shown in FIG. 5, the oscillating tool shaft 40 terminates, at a free end, with an arbor 50. The arbor 50 includes a locating feature sized and shaped for receiving a cutting accessory 54, such as a blade shown in FIGS. 5 and 7. The arbor 50 cooperates with a clamping mechanism 52 for clamping the cutting accessory 54 to the tool shaft 40 for oscillating motion therewith. In the illustrated construction, the clamping mechanism 52 includes a fastener 56 for applying a clamping force to secure the clamping mechanism 52 and cutting accessory 54 to the arbor 50. In other constructions, other clamping mechanisms, such as clamping mechanisms using biasing members (such as springs) to provide the clamping force, may be employed.

Figure 8:
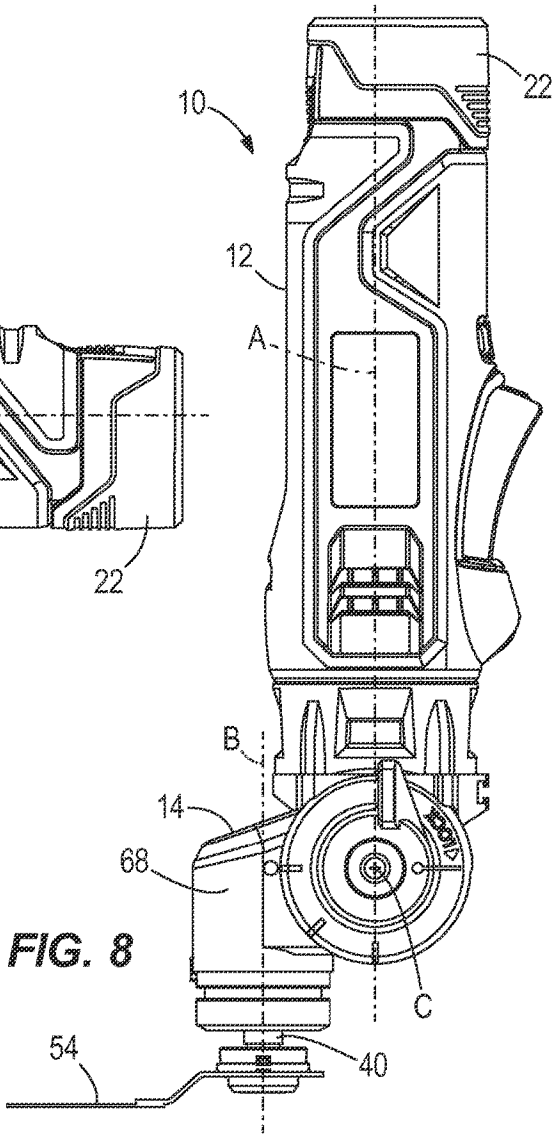
FIG. 8 is a side view of the power tool of FIG. 1 shown in a second position.
Figure 7:
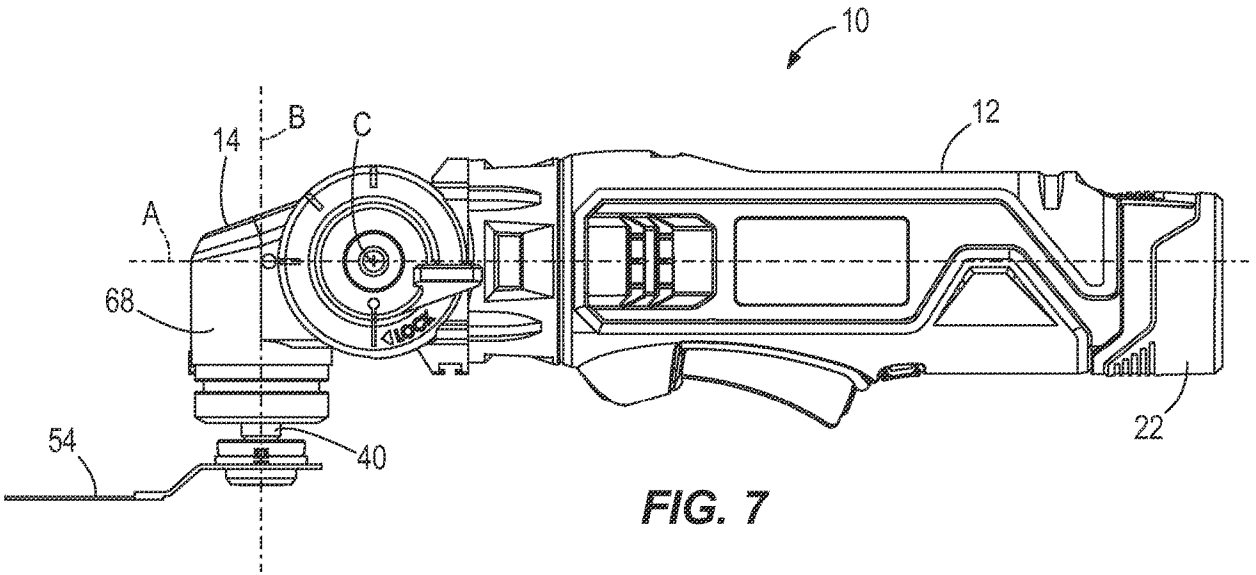
FIG. 7 is a side view of the power tool of FIG. 1 shown in a first position.

FIGS. 7-8 illustrate the tool 10 and the head 14. The pivot portion 15 is rotatable about a pivot axis C between a first position with respect to the handle 12 and the fixed portion 17, shown in FIG. 7, and a second position with respect to the handle 12 and the fixed portion 17, shown in FIG. 8. In the illustrated construction, the pivot portion 15 has a range of rotation of about 90 degrees about the axis C between the first position and the second position. In other constructions, the pivot portion 15 may have a range of motion less than 90 degrees, such as about 85 degrees, about 80 degrees, about 45 degrees, etc. In yet other constructions, the pivot portion 15 may have a range of motion greater than 90 degrees, such as about 95 degrees, about 135 degrees, etc. In the first position, the axis B is substantially perpendicular to the axis A. In the second position, the axis B is substantially parallel to the axis A. In the illustrated construction, the axis B is not coaxial with axis A and is offset from axis A. In other constructions, the axis B may coincide with axis A in the first position.

The pivot axis C intersects the contact portion 66 of the forked member 48 and is disposed substantially perpendicular to the axis A of the motor drive shaft 32 and substantially perpendicular to the axis B of the tool shaft 40 (FIG. 6). The pivot axis C also intersects the eccentric member 46 and the eccentric shaft 42. In some constructions, the pivot axis C intersects the axis A. In other constructions, the pivot axis C passes near the axis A without intersecting axis A. The forked member 48, the tool shaft 40, the arbor 50, the clamping mechanism 52, the fastener 56, and the cutting member 54 rotate together relative to the handle 12 and the fixed portion 17. As the head 14 rotates about the pivot axis C, the contact portions 66 of the arms 69 of the forked member 48 remain in contact with the eccentric member 46 for converting rotation of the eccentric member 46 into oscillation of the forked member 48 throughout the range of motion, as described above.

Figure 9:
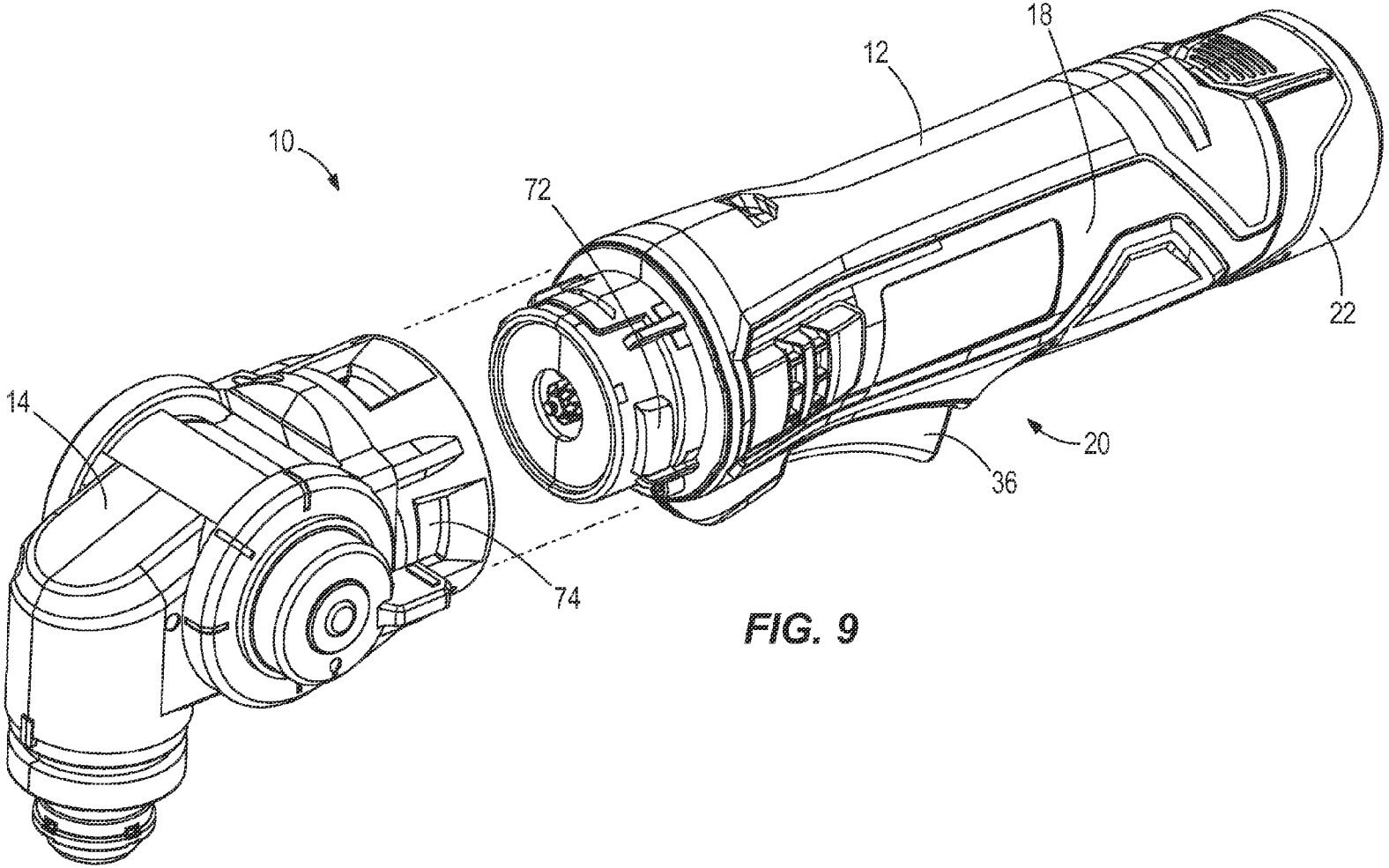
FIG. 9 is a perspective view of the power tool of FIG. 1 illustrating the head detached from the handle.

FIG. 9 illustrates the power tool 10 with the head portion 14 and the handle portion 12 separated. The head portion 14 includes a head attachment feature 74 and the handle 12 includes a handle attachment feature 72 that corresponds with the head attachment feature 74 for coupling the head portion 14 to the handle portion 12. To detach the head portion 14 from the handle portion 12, a user depresses the head attachment feature, such as a pair of opposing locking tabs 72 in the illustrated construction, and pulls the head portion 14 away from the handle portion 12 along the longitudinal axis A. To attach the head portion 14 back to the handle portion 12, the user guides the head portion 14 along the longitudinal axis A toward the handle portion 12 and pushes the two portions together such that the handle attachment feature 72, e.g., locking tabs 72 in the illustrated construction that are depressed down, engages with the head attachment feature 74, e.g., corresponding tab receiving apertures. In the illustrated construction, the locking tabs 72 are biased outward to assist in their engagement with the receiving apertures 74. In other constructions, other attachment features for coupling the head to the handle may be employed.

Figure 10:
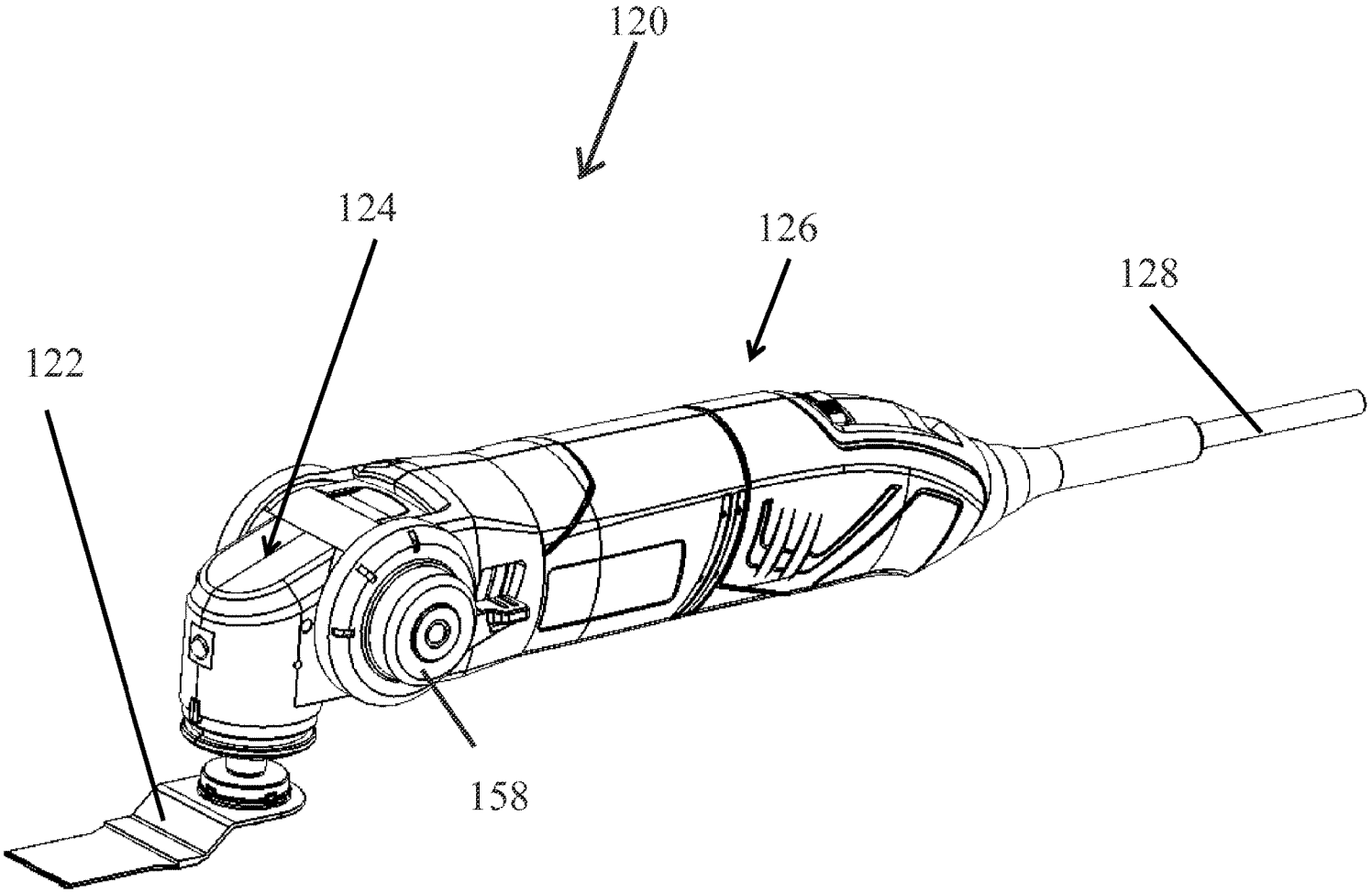
FIG. 10 is a top perspective view of a power tool according to another construction of the invention.

Referring now to FIG. 10, a unitary power tool 120 is illustrated according to another construction of the invention and includes a tool head 124 that is not detachable from a handle (or main body) 126. Such a power tool is also referred to as a multi tool in this description. The power tool 120 is substantially the same as the power tool 10 discussed above except for the tool head 124 not being detachable from the main body 126 and being powered by an electrical cord 128. Therefore, elements of the power tool 10, such as the motor 16, the drive shaft 32, the drive mechanism 38, the forked member 48, the output shaft 40, the arbor 50, the clamping flange 52, the fastener 56, etc., are substantially similar to similarly-referenced elements in the power tool 120 described below despite being given different reference numerals or terminology. Cross-reference is hereby made to the description of the aforementioned elements of the power tool 10 above and the similar elements of the power tool 120.

Furthermore, the locking device 158 (e.g., as illustrated in FIGS. 12-15*b*) employed with the power tool 10 (FIG. 3) and the power tool 120 (FIG. 10) is substantially the same. Therefore, cross-reference is hereby made to the description of locking device 158 below and need not be repeated with respect to the power tool 10 described above.

The power tool 120 includes a power cord 128 connected to a tail end of the main body 126, and the tool head 124 connected to another end of the main body 126 opposite to the power cord 128. In other constructions, the power tool 120 may be powered by a battery, compressed air, or another power source. The tool head 124 is also called an articulating head herein. At the front end of the tool head 124 there is a cutting accessory or tool accessory 122 installed, and in this illustration the tool accessory 122 is a bi-directional metal blade. Note that as mentioned above, the tool accessory 122 can be detached from the tool head 124 in order to replace it with another tool accessory, such as those shown in FIGS. 20*a*-20*d*. The power cord 128 is used to connect the electric circuit and electric motor in the power tool to an external electrical power source. The motor (not shown) is electrically coupled to the external power source via the power switch 144. Specifically, the power switch 144 is a two-position on-off switch. In other constructions, the motor may be a variable speed motor, and the power switch 144 may be a variable-position switch for activating a range of motor speeds.

Figure 11:
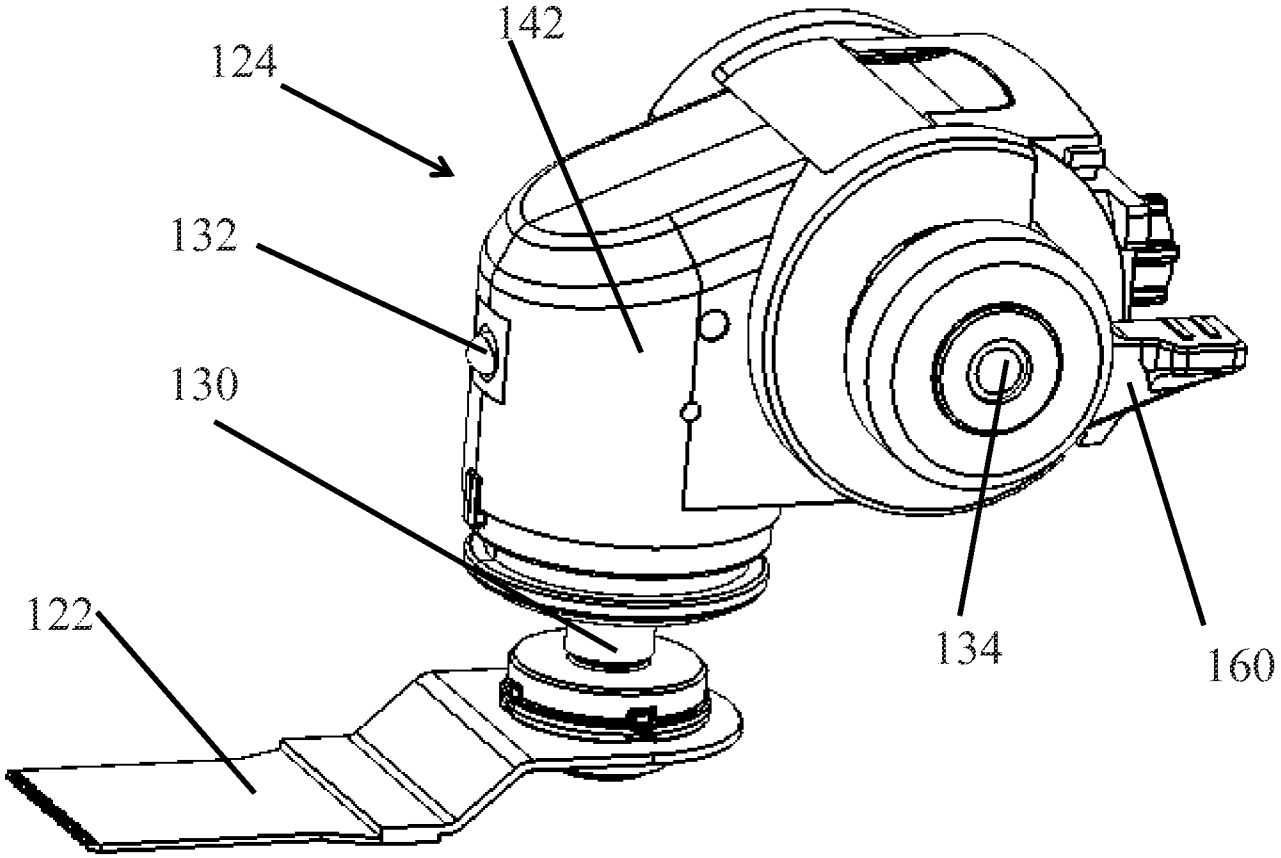
FIG. 11 is an enlarged view of a portion of the power tool shown in FIG. 10.

Referring now to FIG. 11, the tool head 124 is shaped in a substantial L shape. A work light 132 is installed on the front panel of a head casing or housing 142 to provide illumination at the workpiece during operation. At the front end of the tool head 124, an output shaft or tool shaft 130 extends from the head housing 142 and is coupled at its end to the tool accessory 122. The tool head 124 includes hinges 134 for pivotably connecting a base member or fixed portion 143 to an articulating member or pivoting portion 141 of the tool head 124 (FIG. 12), which will be described in greater detail below. There is also a lever handle 160 formed on the tool housing 142 for the user's manipulation. The function of the lever handle 160 will also be described below.

Figure 12:
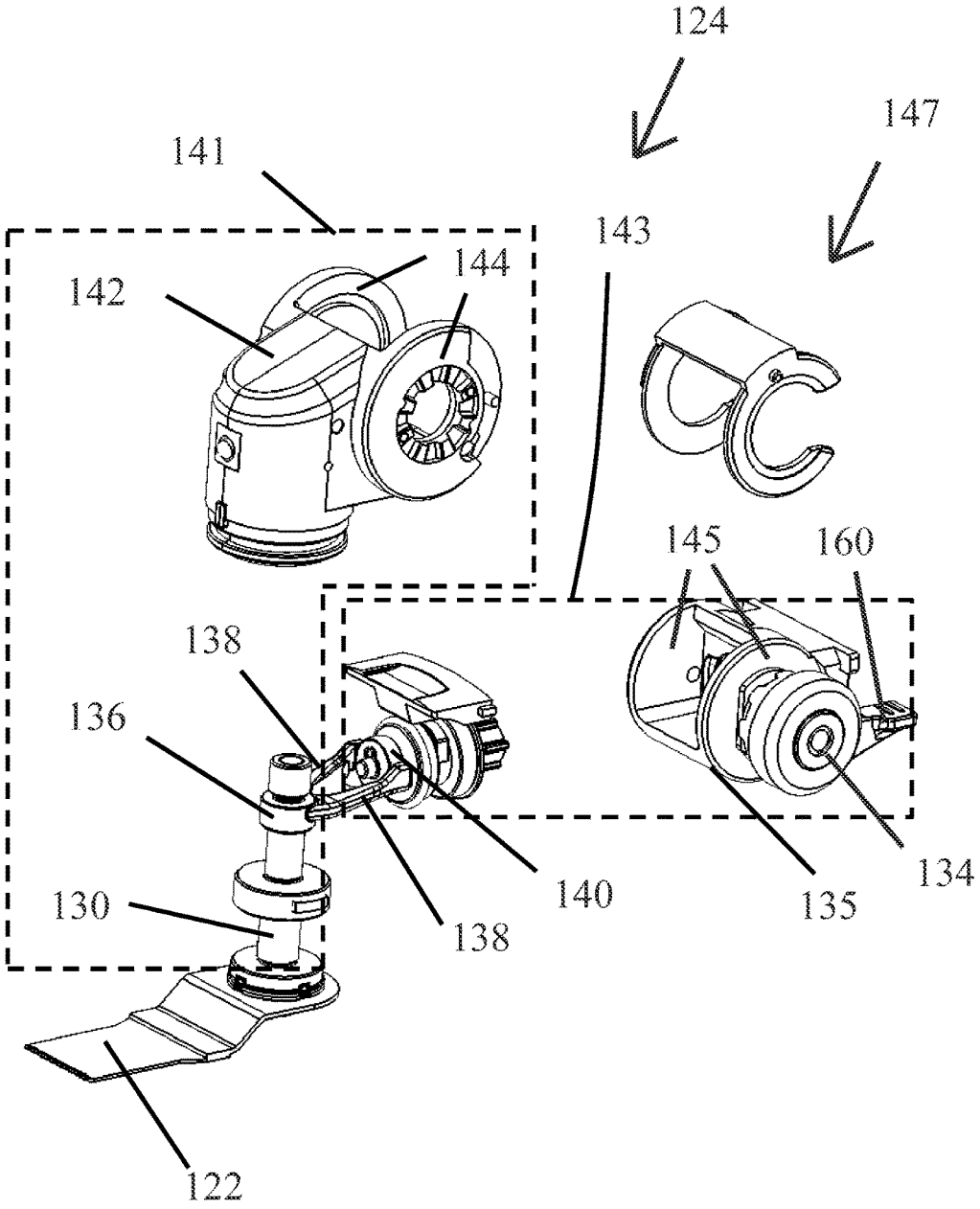
FIG. 12 is an exploded view of a portion of the power tool of FIG. 1 and FIG. 10.

FIG. 12 shows an exploded view of the internal structure of the tool head 124, which includes the base member 143 and the articulating member 141. The articulating member 141 includes the head housing 142 and a series of other components moving along with the head housing 142 when it is pivoted, such as the output shaft 130. The output shaft 130 is also referred to as a second power transmission part herein.

The base member 143 is securely fixed onto the main body of the power tool 10, 120. The base member 143 includes a base housing 135, which is secures the base member 143 to the main body 12, 126 of the power tool, and a drive mechanism or first power transmission part (e.g., drive mechanism 38 as described above) is arranged in the base housing 135. The base housing 135, as shown in FIG. 12, contains two generally circularly-shaped side portions 145, and the head housing 142 similarly also contains two generally circularly-shaped side portions 144. Therefore, the head housing 142 of the articulating member 141 is hingedly connected to the base housing 135 at the two pairs of side portions 144, 145 along a pivoting axis (e.g., axis C shown in FIGS. 6-8), which substantially coincides with the respective centers of the generally circularly-shaped side portions 144, 145.

Figure 13C:
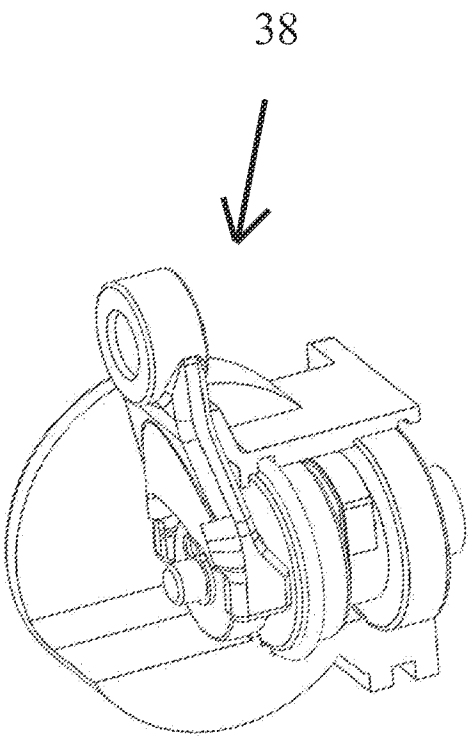
FIGS. 13*a*-13*c* are partial views of a forked member of the power tool of FIG. 1 and FIG. 10 illustrating the forked member pivoting to different angles.
Figure 13B:
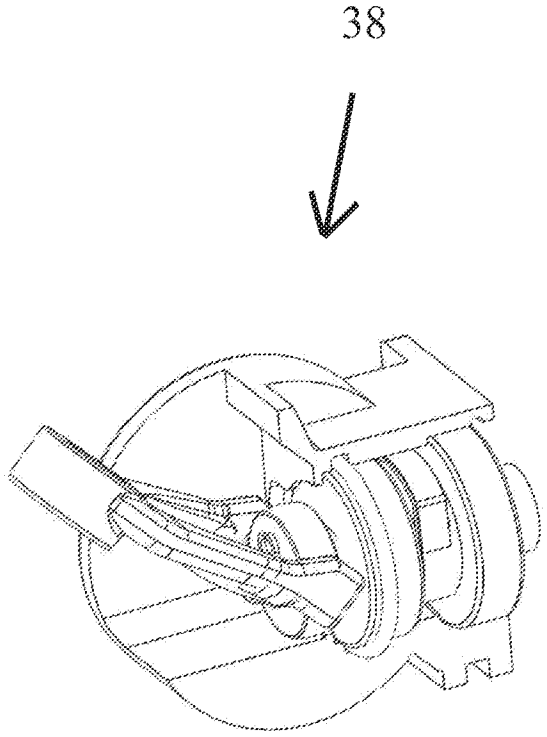
Figure 13A:
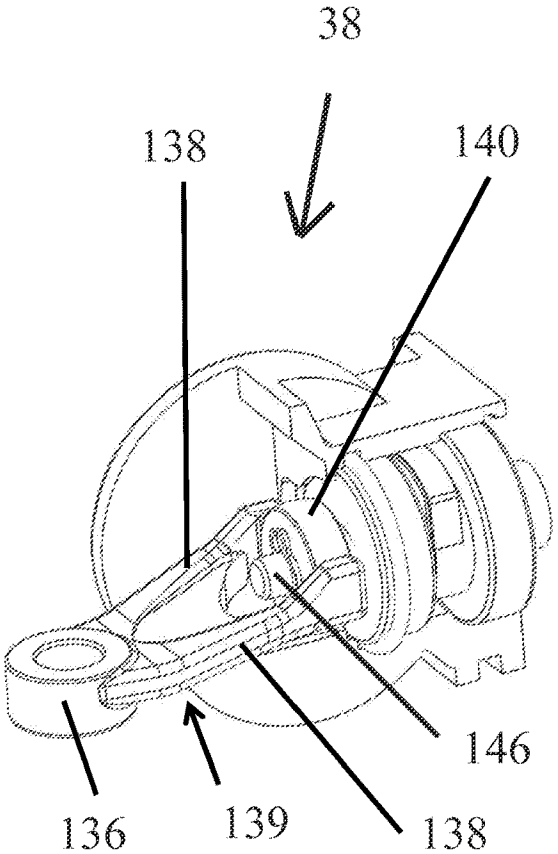

Referring to FIGS. 13*a*-*c*, the first power transmission part 38 includes an eccentric bearing 140 and an eccentric shaft 146 (e.g., see also FIG. 5, eccentric portion 60). The eccentric shaft has one end mechanically coupled to the motor shaft of the electric motor of the power tool 10, 120 (e.g., see also FIG. 5, drive shaft 32) and therefore the eccentric shaft receives mechanical driving power from the motor. Such a mechanical driving power is in the form of centric rotary motion from the motor. The eccentric shaft however contains an irregular eccentric portion and the eccentric bearing 140 (e.g., similarly herein, the eccentric bearing 46 described above) is press-fit on the eccentric portion of the eccentric shaft.

The second power transmission part 130 in the articulating member 141 is mechanically coupled to the first power transmission part in the base member 143. In particular, an intermediate transmission part 139 (e.g., similarly herein, the forked member 48 discussed above) is coupled between the second power transmission part and the first power transmission part. A joint 147 of the first power transmission part and the intermediate transmission part 139 is arranged between the two side portions 144, 145 of the base member 135 and intersected by the pivoting axis (e.g., axis C described above), as illustrated in FIGS. 6, 12 and 13*a*-13*c*. The intermediate transmission part is a forked member 139, which further comprises two arms or prongs 138 and a sleeve or coupling member 136. The sleeve 136 is located at an opposite end of the forked member 139 to the prongs 138 along a longitudinal direction of the forked member 139. The two ends or contact portions of the prongs 138 contact opposite sides of the eccentric bearing 140 along a diameter thereof. The contact portions of the two prongs 138 engage with the corresponding surfaces of the eccentric bearing 140, thus forming the joint of the prongs 138 and the eccentric bearing 140. The pivoting axis C intersecting the opposite sides of the eccentric bearing 140, around which the forked member 139 pivots with respect to the eccentric bearing 140, is the same pivoting axis of the tool head 124 and its head housing 142 with respect to the main body 126.

As the prongs 138 of the forked member 139 "clamp" the opposite sides of the eccentric bearing 140, the forked member 139 is adapted to pivot around its joint with respect to the base member 143. FIG. 13*a* shows the configuration when the forked member 139 is pivoted to be substantially parallel to the longitudinal direction of the main body of the power tool. In this case, the axis of the tool shaft (e.g., see axis B in FIG. 7) in the tool head is perpendicular to the longitudinal direction of the main body (e.g., see axis A in FIG. 7). In the case of FIG. 13*b*, the forked member 139 is pivoted to form a 45 degree angle with the longitudinal direction of the main body of the power tool 10, 120. In this case, the axis of the tool shaft (e.g., axis B) in the tool head is also forming a 45 degree angle with the longitudinal direction of the main body (e.g., axis A). In the case of FIG. 13*c*, the forked member 139 is pivoted to form a 90 degree angle with the longitudinal direction (e.g., axis A) of the main body of the power tool, so that the forked member 139 is substantially perpendicular to the latter. In this case the axis of the tool shaft (e.g., axis B) in the tool head is forming a substantially parallel with the longitudinal direction of the main body (e.g., see FIG. 8).

Figure 14:
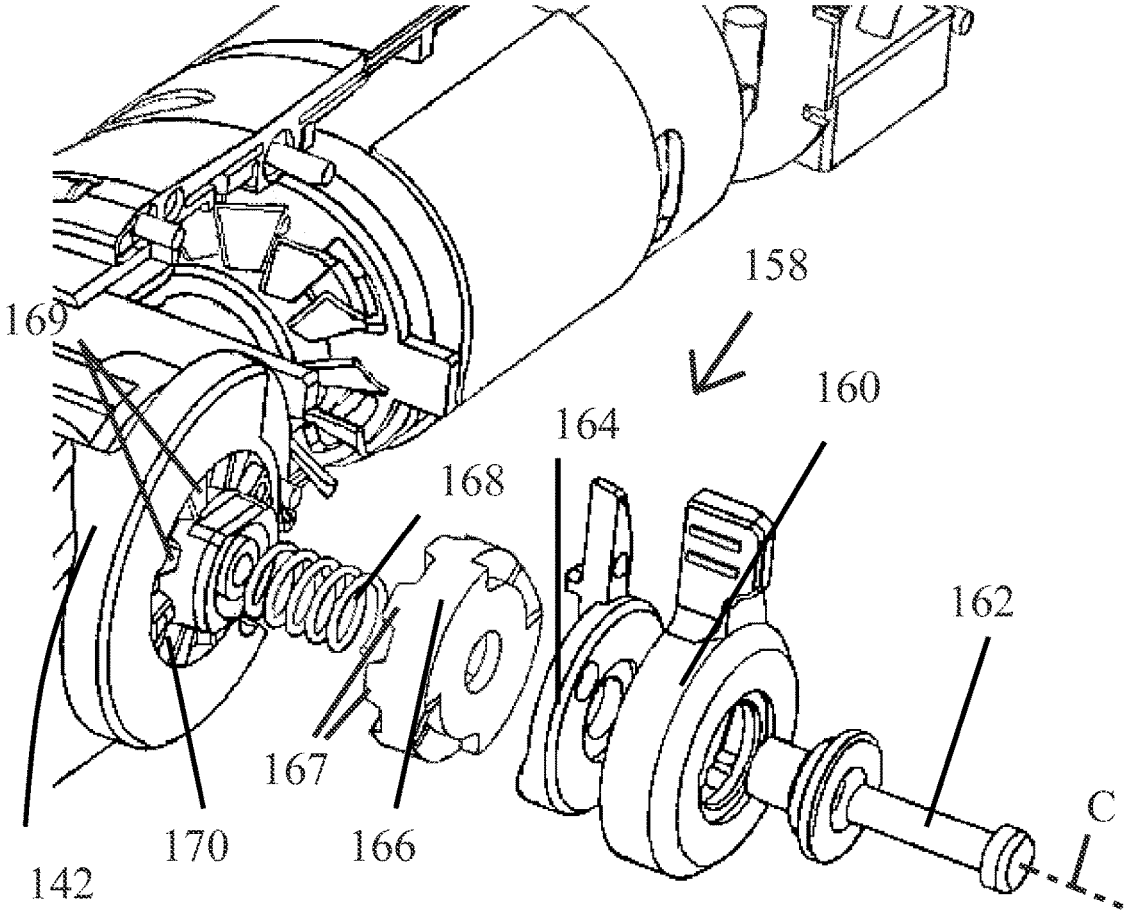
FIG. 14 is an exploded view of a locking device of the power tool shown in FIG. 1 and FIG. 10.

The articulating head according to the invention further includes the locking device 158 connected to the articulating member 141 in order to lock the relative orientation of the articulating member 141 to the base member 143. A construction of such a locking device 158 is illustrated in FIG. 3, FIG. 14, and FIGS. 15*a*-15*b*. As shown in FIG. 14, the locking device 158 contains in sequence a first locking member or head locking member 170, a second locking member or transitional locking member 166 and a third locking member or actuation locking member 164 arranged coaxially with each other and all hinged on a lock screw 162. In other constructions, the lock screw 162 can be replaced with a lock shaft. The first locking member 170 is a first lock plate fixedly coupled to the articulating member 141, and is rotatable around the pivoting axis C together with the articulating member 141. The first lock plate 170 is centered at the pivoting axis C and perpendicular to the pivoting axis C as previously described. The first lock plate 170 is generally situated within the head housing 142. The second locking member 166 is a second lock plate capable of engaging with the first lock plate 170. Note that as shown in FIG. 14, the side of the second lock plate 166 facing the first lock plate 170 is formed with continuous teeth 167. Correspondingly, the facing side of the first lock plate 170 is also formed with teeth 169 in order for engagement with the teeth 167 on the second lock plate 166. The second lock plate 166 is fixedly secured in the lock mechanism and is not rotatable. However, the second lock plate 166 is normally biased by a biasing member or spring 168 into engagement with the first lock plate 170, and the biasing member 168 is located between the second lock plate 166 and said first lock plate 170. As shown in FIG. 14, the biasing member is preferably a spring; however, in other constructions, the biasing member may include other types of biasing members.

Figure 15A:
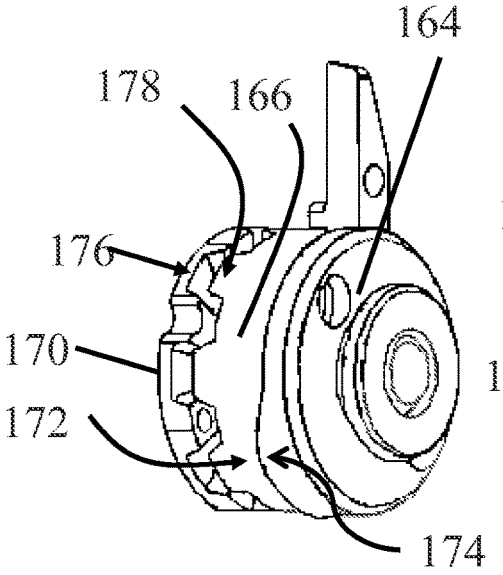
FIGS. 15*a*-15*b* are enlarged views of the locking device of FIG. 14 showing the locking device in a free position and a lock position, respectively.

The third locking member 164 is a lever button 164 adapted to rotate about axis C between at least a lock position and a free position. There is further a lever handle 160 formed in a similar shape as the lever button 164, which essentially encapsulates the latter in the illustrated construction. The lever handle 160 is made of plastic or rubber in order for the user to manipulate the locking member 164 more comfortably, without the need to touch the metal made lever button 164. With reference to FIG. 15*a*, the second lock plate 166 is capable of engaging with the lever button 164. The side of the lever button 164 facing the second lock plate 166 is not a uniform surface, but rather it contains upheaved region or first cam surface 174 along some portions of the circumference. Similarly, the side of the second lock plate 166 facing the lever button 164 also contains depressed regions or second cam surface 172 matching the upheaved regions 174.

Figure 16A:
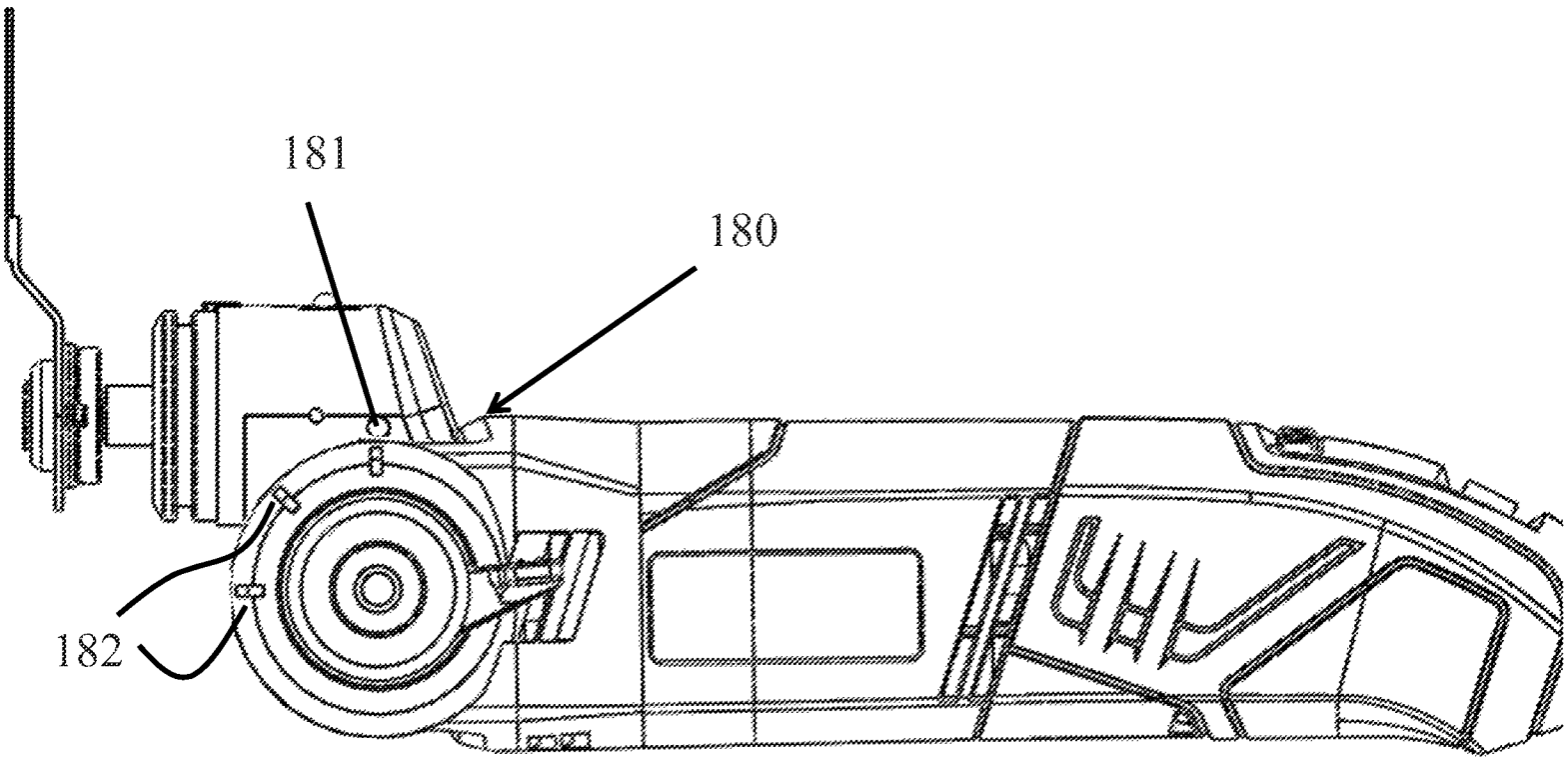
FIG. 16*a* is a side view of the power tool of FIG. 10 having an articulating head pivoted to 90 degrees with respect to a tool body.
Figure 16B:
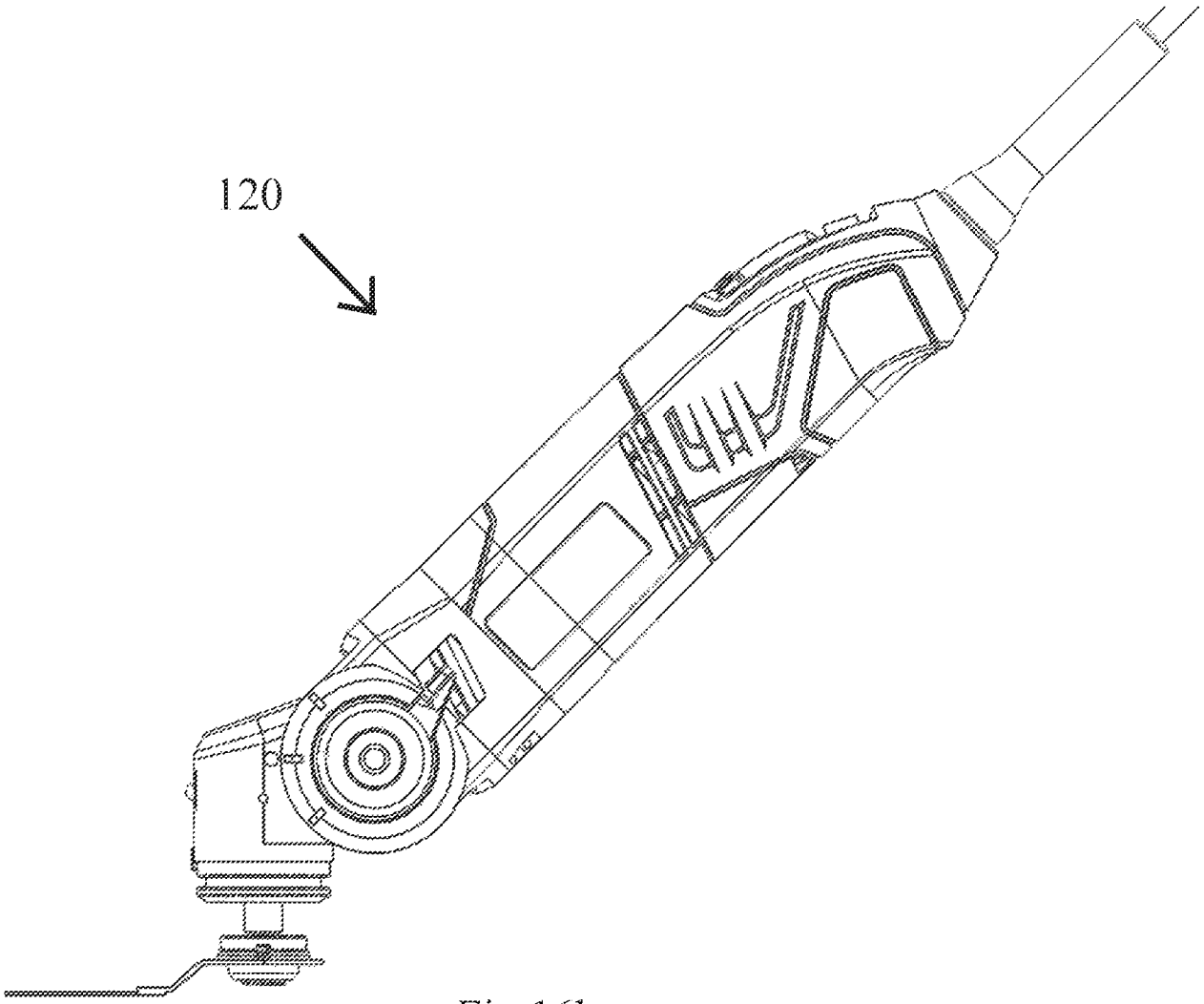
FIG. 16*b* is a side view of the power tool of FIG. 10 having an articulating head pivoted to 45 degrees with respect to a tool body.
Figure 16C:
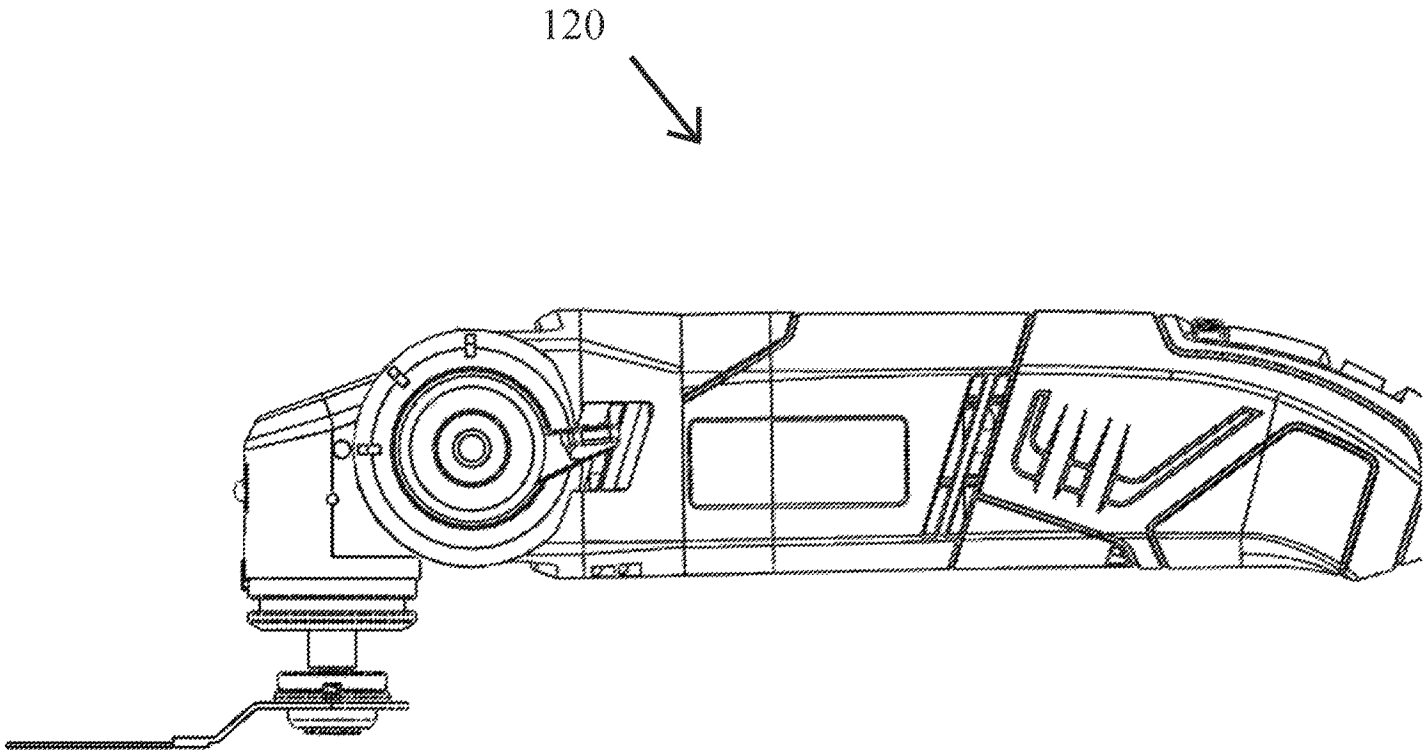
FIG. 16*c* is a side view of the power tool of FIG. 10 having an articulating head pivoted to 0 degrees with respect to a tool body.

Now turning to the operation of the device described above, FIGS. 16*a*-16*c* show how the articulating head of the power tool 10, 120 according to the present invention may be switched from one angular position to another among a plurality of possible positions. During operation, the user first checks and ensures that the lever handle 160 is set to the free position (which will be described in greater detail below). Then, since the articulating head is freely pivotable with regards to the main body of the power tool, the user can move the articulating head to a desired position or orientation, e.g., by grasping the articulating portion 141 and applying a force to move the articulating portion with respect to the base portion 143 about the pivot axis C. In the construction shown in FIGS. 16*a*-16*c* there are three predetermined positions, which are observed by the user via the indicator 181 on the articulating head and marks 182 on the base housing. Each of the marks 182 indicates a predetermined angular position, of which there are three in the illustrated construction. The illustration in FIG. 16*a* shows the configuration when the articulating head is substantially parallel with the longitudinal direction of the main body (0 degree). The illustration in FIG. 16*b* shows the configuration when the articulating head is forming a 45 degrees angle with the longitudinal direction of the main body. The illustration in FIG. 16*c* shows the configuration when the articulating head is forming a 90 degrees angle with the longitudinal direction of the main body.

Note that as mentioned above, the intermediate transmission part 48, 139 for transmitting the driving power from the base member 143 to the articulating member 141 pivots at the same time as the articulating member 141. Since the axis of pivoting for the forked member 139 in FIG. 12 is the same as the pivoting axis for the head housing 142 in FIG. 11 (e.g., pivot axis C), the forked member 48, 139 maintains its relative position to the head housing 142 during any pivoting movement. Nonetheless, during the pivoting movement the power transmission path, i.e. from the eccentric bearing 140 to the tool shaft 130 in FIG. 12 is not interrupted, because at any angular position of the forked member 139 the two prongs 138 are always press-fit onto opposite sides of the eccentric bearing 46, 140. The forked member 48, 139 is capable of transforming the eccentric rotation motion from the eccentric bearing 140 into an oscillation of the coupling member 136 and in turn the tool shaft 40, 130. Briefly, the eccentric movement of the eccentric bearing 140 leads to the bearing 140 moving reciprocally on the lateral direction, thus urging the two prongs 138 of the forked member to reciprocally move on the lateral direction as well. However, since both prongs 138 are ultimately linked to one point that is the coupling member 136, the coupling member 136 with its central axis fixed would be driven to oscillate within a small range of angle. Such an oscillating motion of the coupling member 136 is transmitted to the tool shaft 130 and in turn to the tool accessory 122 so that the tool accessory 122 can perform desired oscillating operation.

Figure 15B:
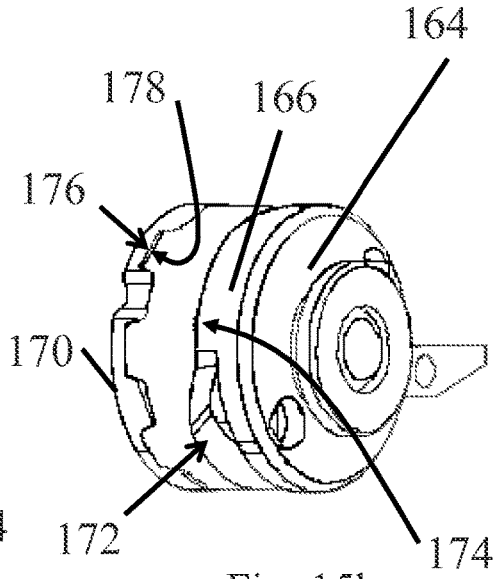

As mentioned above in the constructions shown in FIGS. 16*a*-16*c*, the articulating head can be pivoted to one of the three possible positions. After the user moves the articulating head to the desired position, the user has to switch the lever handle 160 from a free position to a lock position. Referring to FIGS. 15*a* and 15*b*, configuration of the locking member at its free status is shown in FIG. 15*a*, and the configuration of the locking member at its locked status is shown in FIG. 15*b*. In FIG. 15*a*, when the lever handle and the lever button 164 is at the free position (the figure showing the extruding handle portion of the lever button 164 pointing upward, e.g., substantially perpendicular to the axis B), the second lock plate 166 precisely fit with the lever button 164 as the upheaved region 174 on the lever button 164 engages closely with the depressed region 172 on the second lock plate 166. The second lock plate 166 is kept in the engagement with the lever button 164 since there is a biasing force from the spring 168 pushing the second lock plate 166 towards the lever button 164. However, when the user presses down the lever handle and thus turning the button 164 to the position as shown in FIG. 15*b*, the upheaved region 174 on the lever button 164 would move angularly upward as a result of the clockwise rotation of the lever button 164 in FIGS. 15*a* and 15*b*. As mentioned previously, the second lock plate 166 is fixedly secured in the lock mechanism and it is not rotatable. As there is a gradual slope at the boundary between the upheaved region 174 and other regions on the lever button 164, rotation of the lever button 164 relative to the fixed second lock plate 166 would force the upheaved region 174 to leave the depressed region 172 on the second lock plate 166 and come into contact with normal, undepressed regions on the second lock plate 166. Since the position of the lever button 164 is fixed along the pivoting axis, increased edge width of the lever button 164 overcomes the spring force of spring 168 and pushes the second lock plate 166 toward the first lock plate 170. Then, the first lock plate 170 comes into engagement with the second lock plate 166 since there are teeth 167, 169 on both of their facing sides meshing with each other. As a result, the rotation of the first lock plate 170, and thus the articulating member 141, is inhibited by the second lock plate 166 since the second lock plate 166 is fixed in position. Therefore, the user can freely move the articulating member to a desired orientation, and then locks the articulating member at this position by using the locking member mentioned above.

Figure 17A:
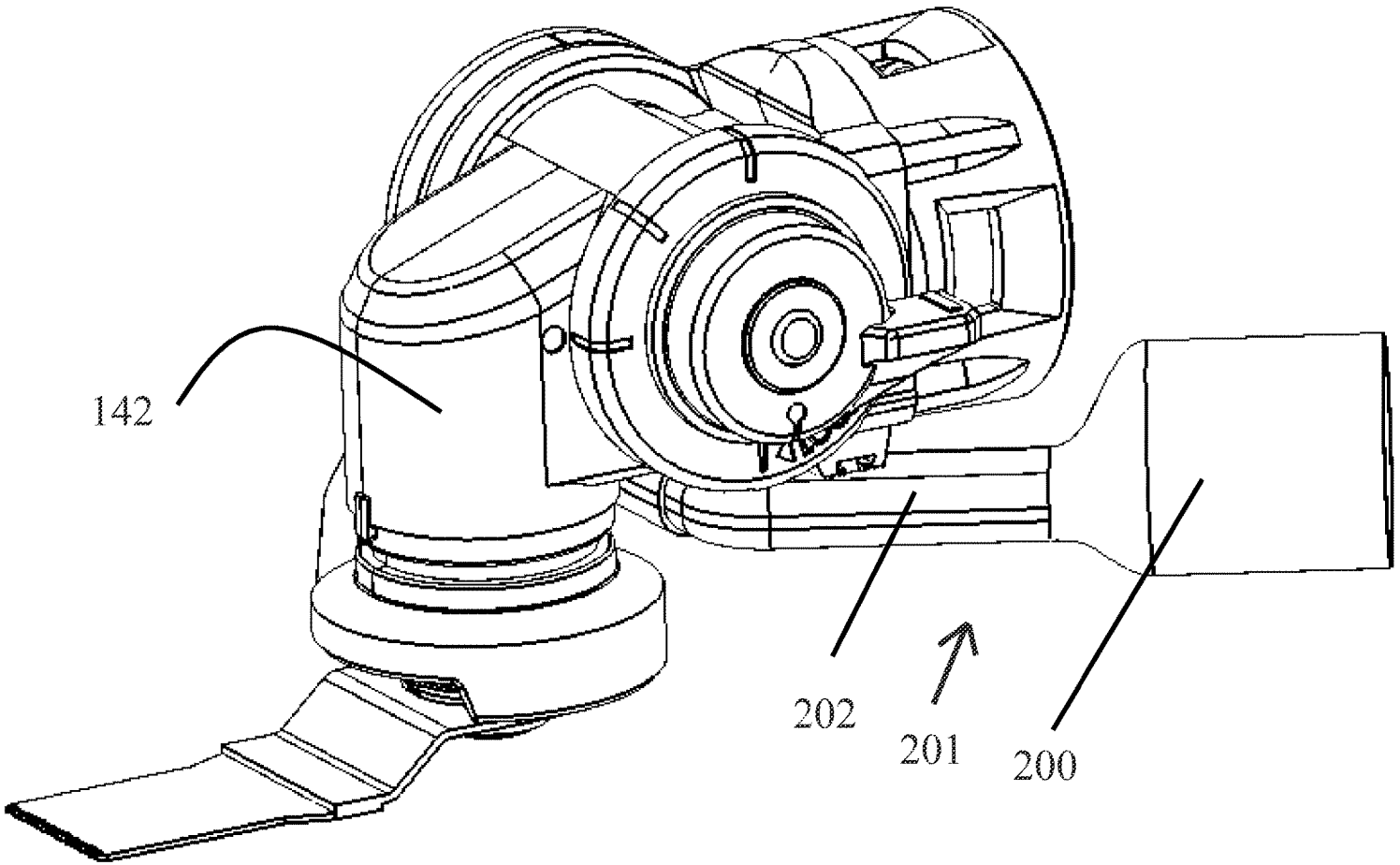
FIG. 17*a* is a perspective view of a portion of the power tool of FIG. 1 having a dust extraction attachment.
Figure 17B:
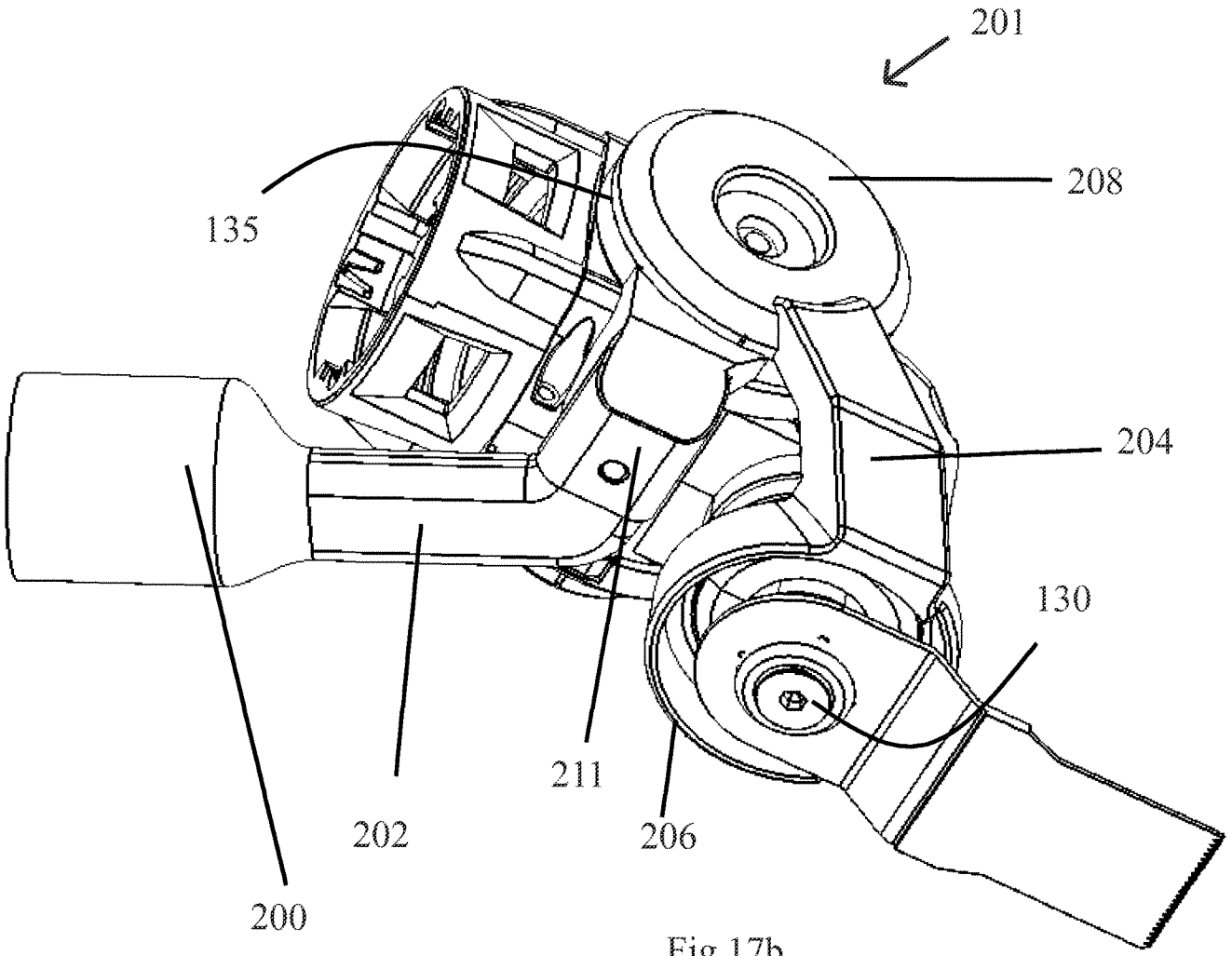
FIG. 17*b* is a bottom perspective view of a portion of the power tool of FIG. 1 having the dust extraction attachment of FIG. 17*a*.
Figure 18:
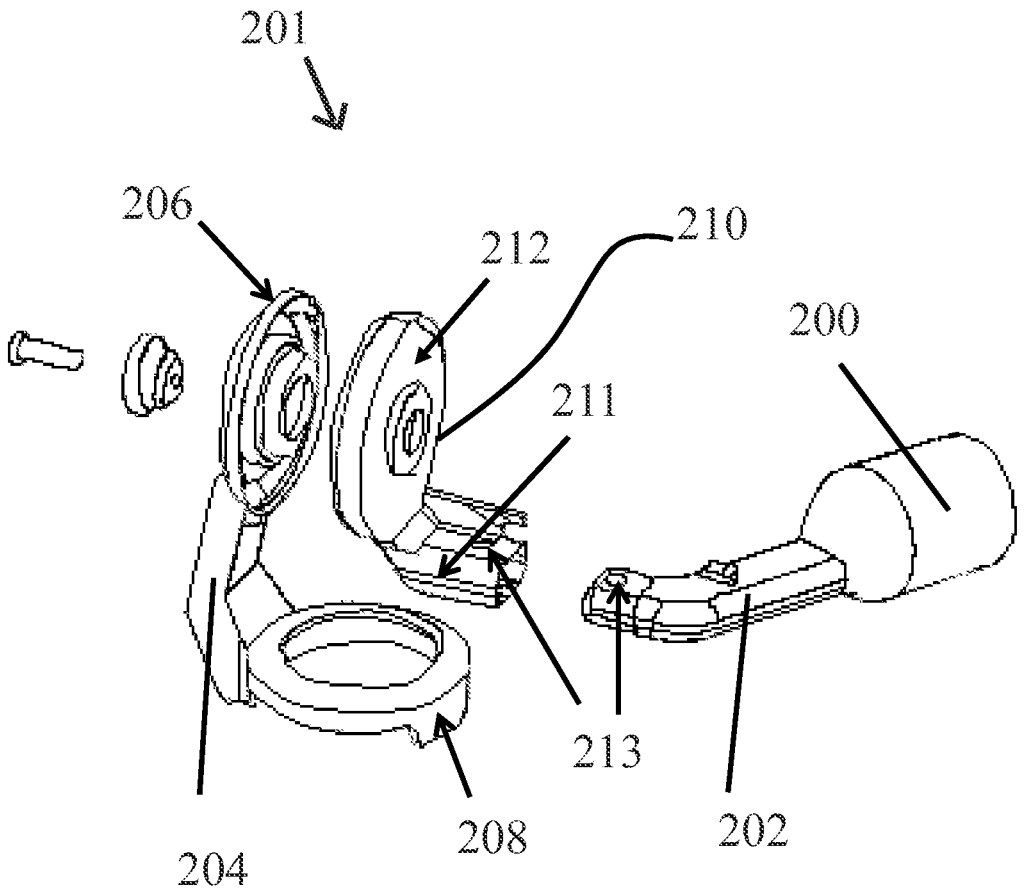
FIG. 18 is an exploded view of the dust extraction attachment shown in FIGS. 17*a* and 17*b*.

The power tool 10, 120 with the articulating head may also be equipped with a dust extraction attachment 201 as illustrated in FIGS. 17*a*, 17*b* and 18. The dust extraction attachment 201 is a separate tool attachment installed on the articulating head, and depending on the actual work requirement it may also be removed from the multi tool. As shown in FIGS. 17*a* and 17*b*, the dust extraction attachment 201 includes an air outlet 200 for expelling the dirty air mixed with dust produced during tool operation. The air outlet 200 is connected and in air communication with a guide tube 202, where the latter is connected to the head housing 142.

Turning now to FIG. 18, the dust extraction attachment 201 further includes a circular dust collecting part 210, which can be secured on the articulating head with the output shaft (not shown) as described previously crossing through a central bore of the dust collecting part 210. Note that the dust collecting part 210 includes a socket 211 and a main circular body 212. The socket 211 is movably connected to the main circular body 212 so that the direction of the socket 211 and in turn the air outlet 200 can be adjusted according to the user's need. For example, in the illustration of FIG. 17*b*, the socket 211 is arranged to be parallel to the plane of the main circular body 212. Whereas in FIG. 18, the socket 211 is arranged to be perpendicular to the plane of the main circular body 212. The socket 211 is connected to the guide tube 202 and kept in air communication with the guide tube 202. The socket 211 is connected to the guide tube 202, such as by way of the pore-protrusion mechanism 213 shown in FIG. 18. The main circular body 212 of the dust collecting part 210 is formed with some air inlets (not shown) where dust removed from the workpiece by the tool accessory will be suctioned into the air inlets and then moved all the way to an external suction device connected to the air outlet 200. In one construction, the air outlet 200 is an adapter for an external suction device, such as a vacuum cleaner.

In addition, to more securely install the dust extraction attachment 201 to the articulating head, the dust extraction attachment further contains a supporting arm 204. One end of the supporting arm 204 is coupled to the dust collecting part 210 via a similarly shaped circular support 206. Another end of the supporting arm 104 is formed with a ring shaped fastener 208 rotatably fixed to the base housing 135 as mentioned above. Since the ring shaped fastener 208 is rotatably fixed to the base housing 135, the supporting arm 204 is adapted to pivot with respect to the base housing 135 at the same time with the articulating head. The supporting arm 204 is therefore capable of providing support to the dust extraction attachment 201 at any predetermined angular position of the articulating head.

Figure 19A:
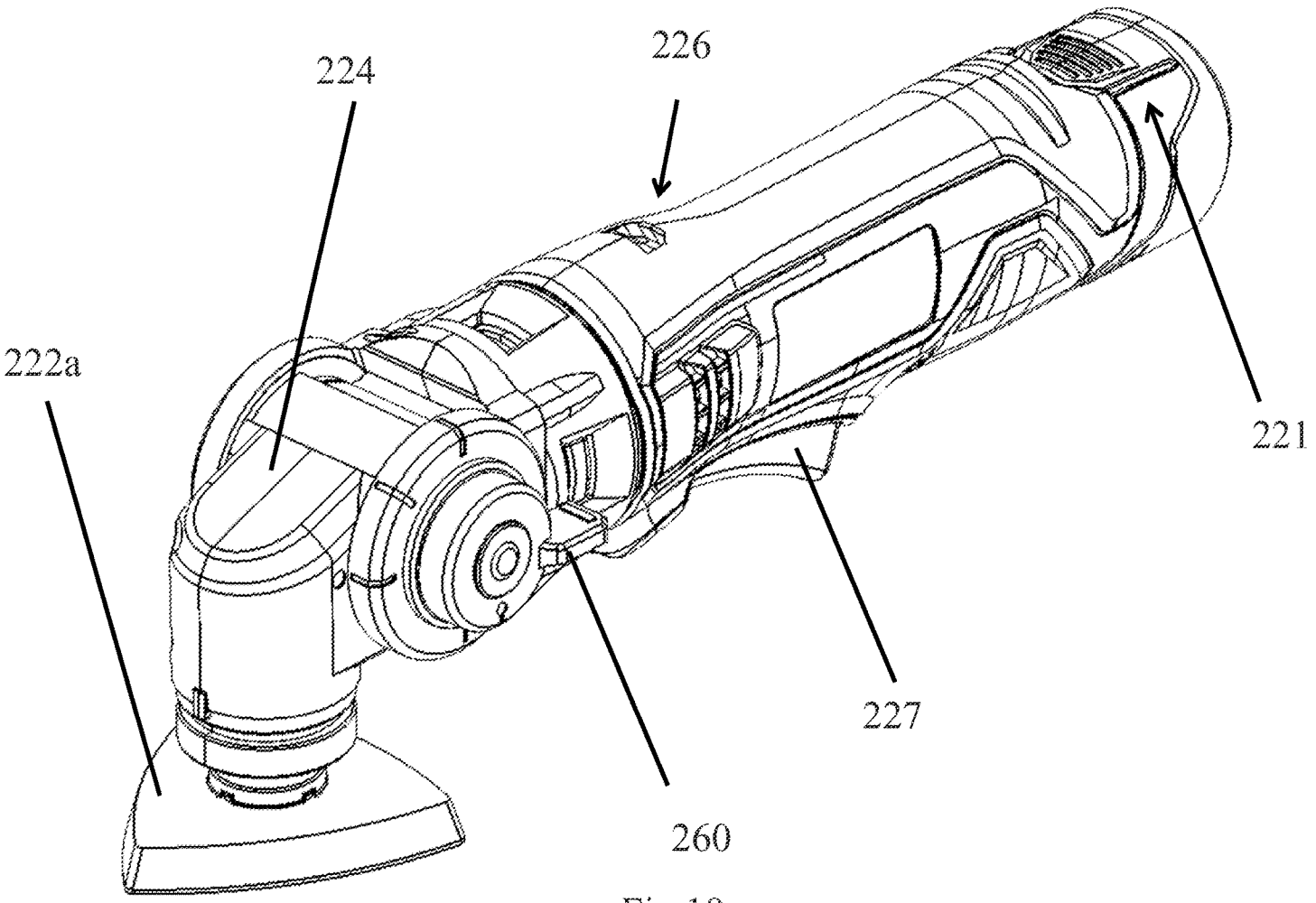
FIG. 19*a* is a top perspective view of the power tool of FIG. 1 having a sanding pad.
Figure 19B:
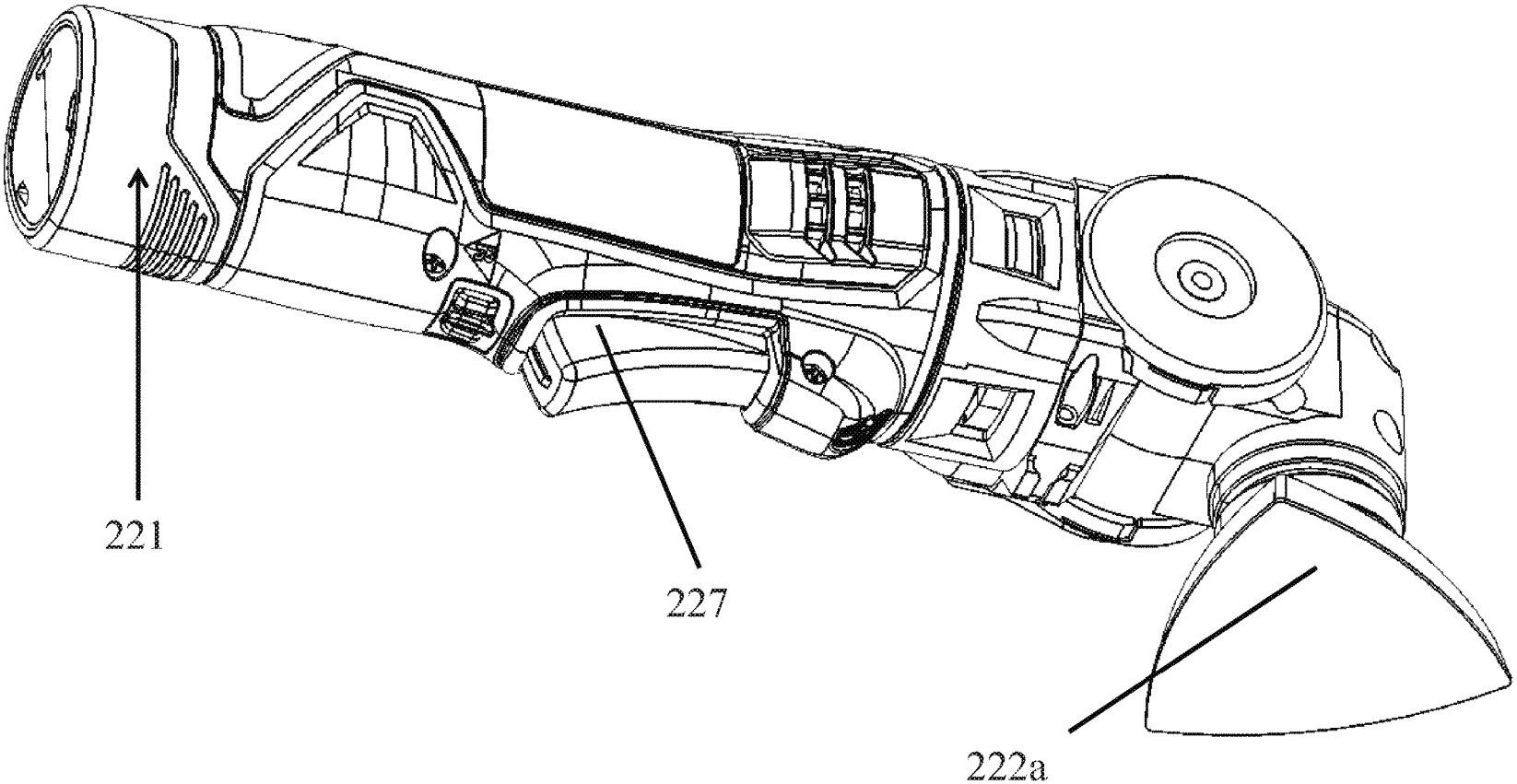
FIG. 19*b* is a bottom perspective view of the power tool of FIG. 1 having the sanding pad of FIG. 19*a*.
Figure 19C:
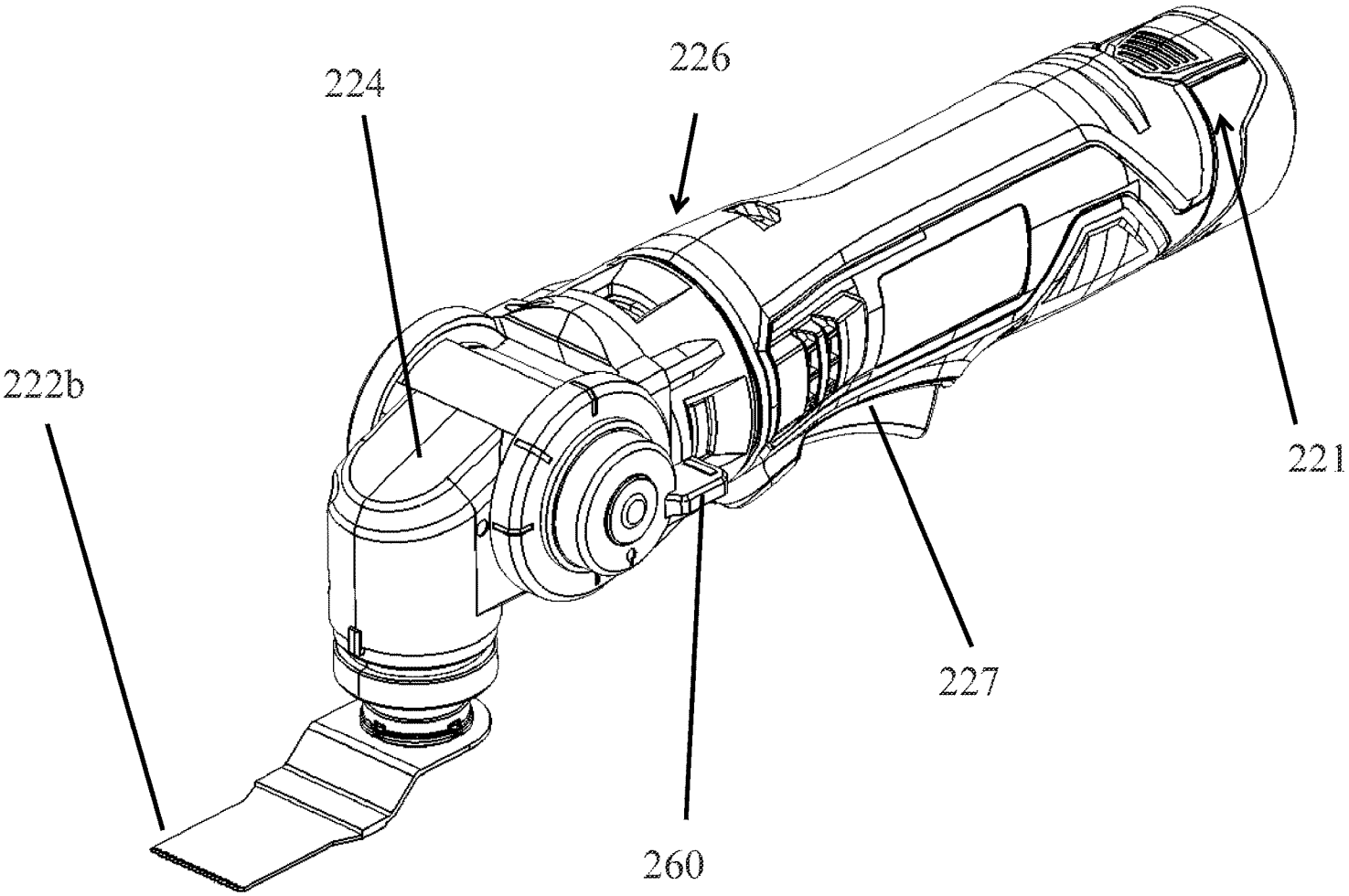
FIG. 19*c* is a top perspective view of the power tool of FIG. 1 having a blade cutter.
Figure 19D:
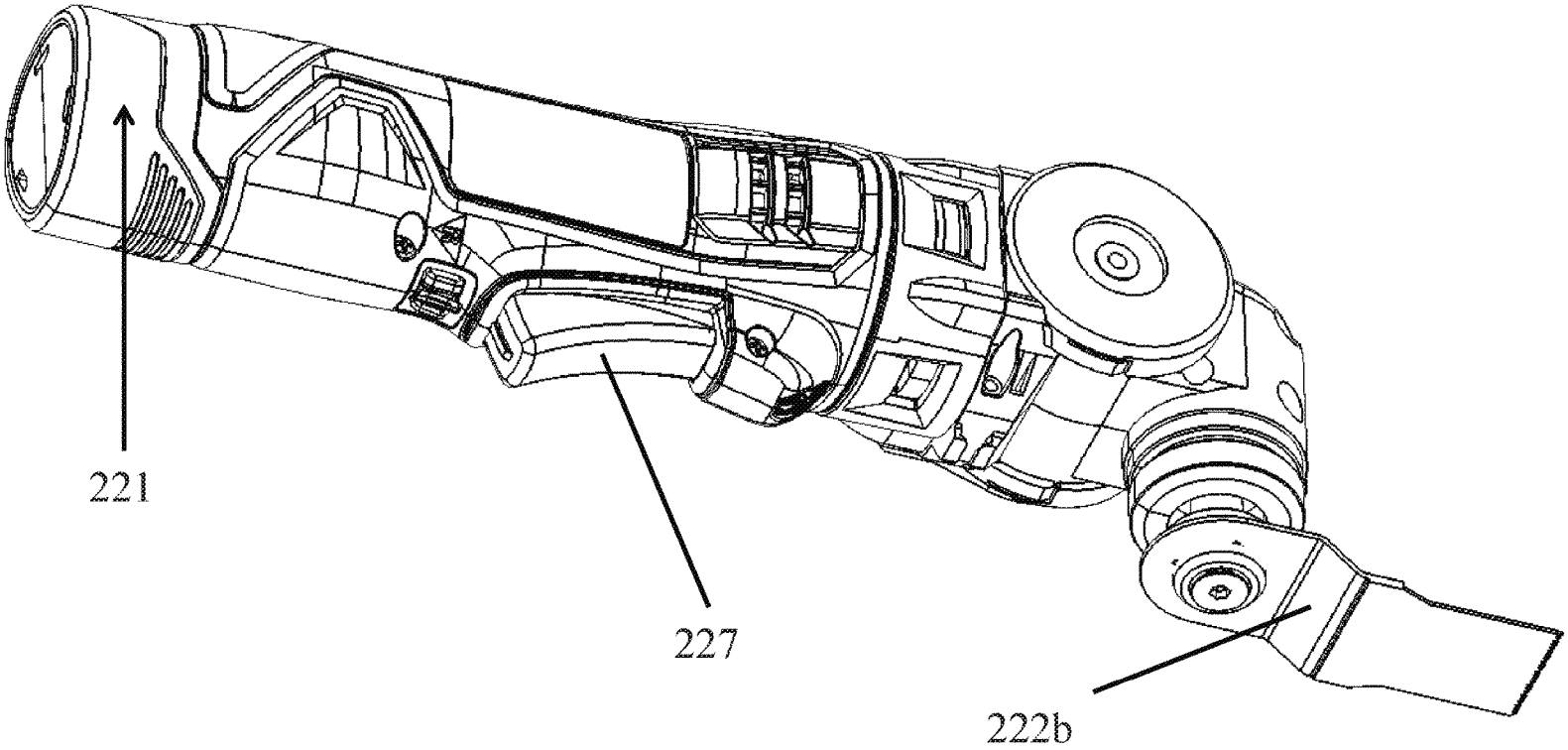
FIG. 19*d* is a bottom perspective view of the power tool of FIG. 1 having the blade cutter of FIG. 19*c*.

FIGS. 19*a*-20*d* in general illustrate various tool accessories attached to the power tool (e.g., the power tools 10, 120) that includes the articulating head mechanism described above. In particular, FIGS. 19*a*-19*b* illustrate the power tool (e.g., the power tool 10 described above) equipped with a sanding pad 222*a* installed on a tool head 224. There is also a user-actuated trigger 227 located on a main body 226 of the multi tool, so that the user can press the trigger 227 in order to activate the multi tool or stop its function, as described above. The multi tool shown in FIGS. 19*a*-19*d* runs on a battery, and a detachable battery (e.g., as described above) is received in a battery compartment 221 located at the end of the main body 226. FIGS. 19*c*-19*d* illustrate the same multi tool as FIGS. 19*a*-19*b*, with the only difference that the multi tool as shown in FIGS. 19*c*-19*d* is installed with a blade cutter 222*b*.

Figure 20A:
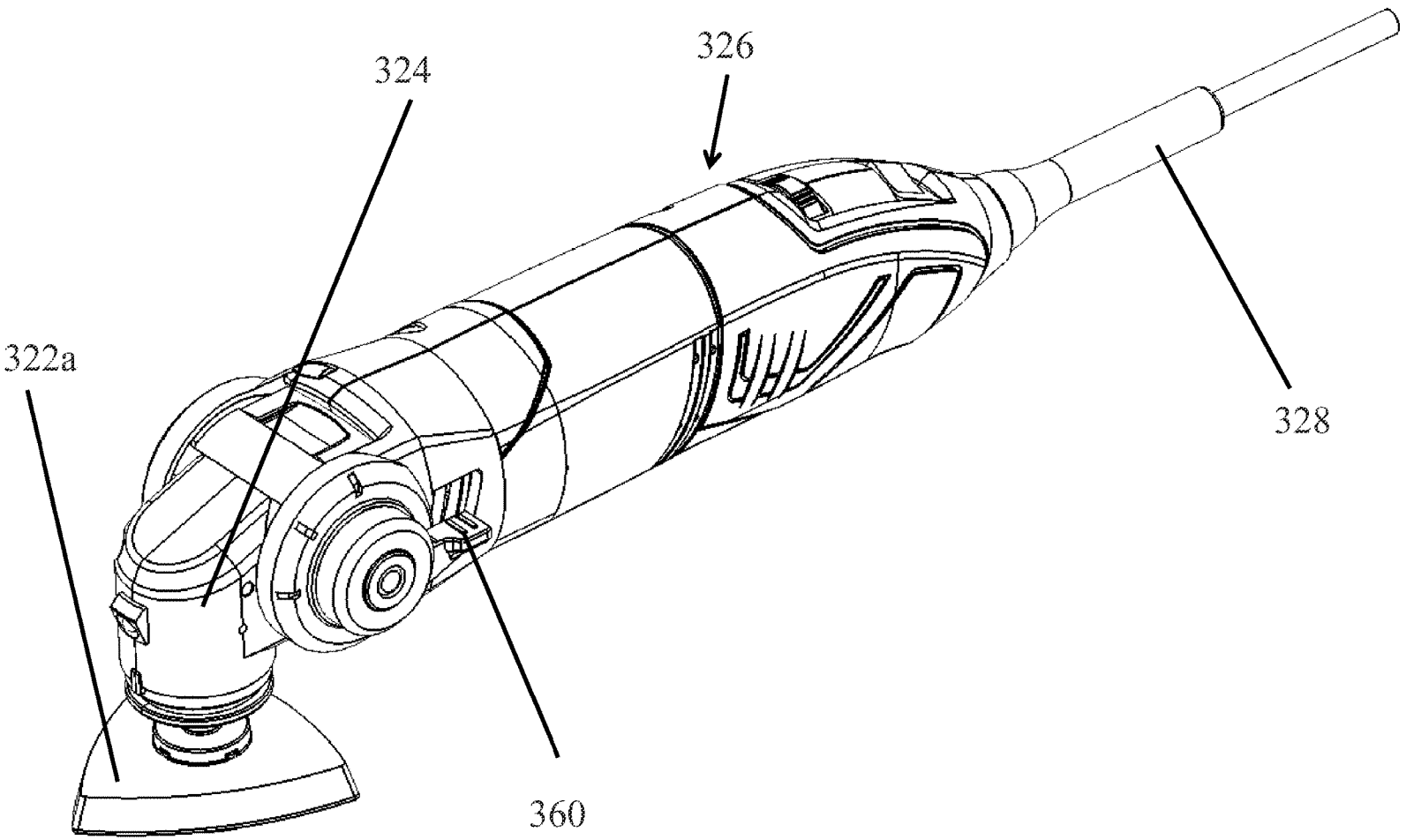
FIG. 20*a* is a top perspective view of the power tool of FIG. 10 having a sanding pad.
Figure 20B:
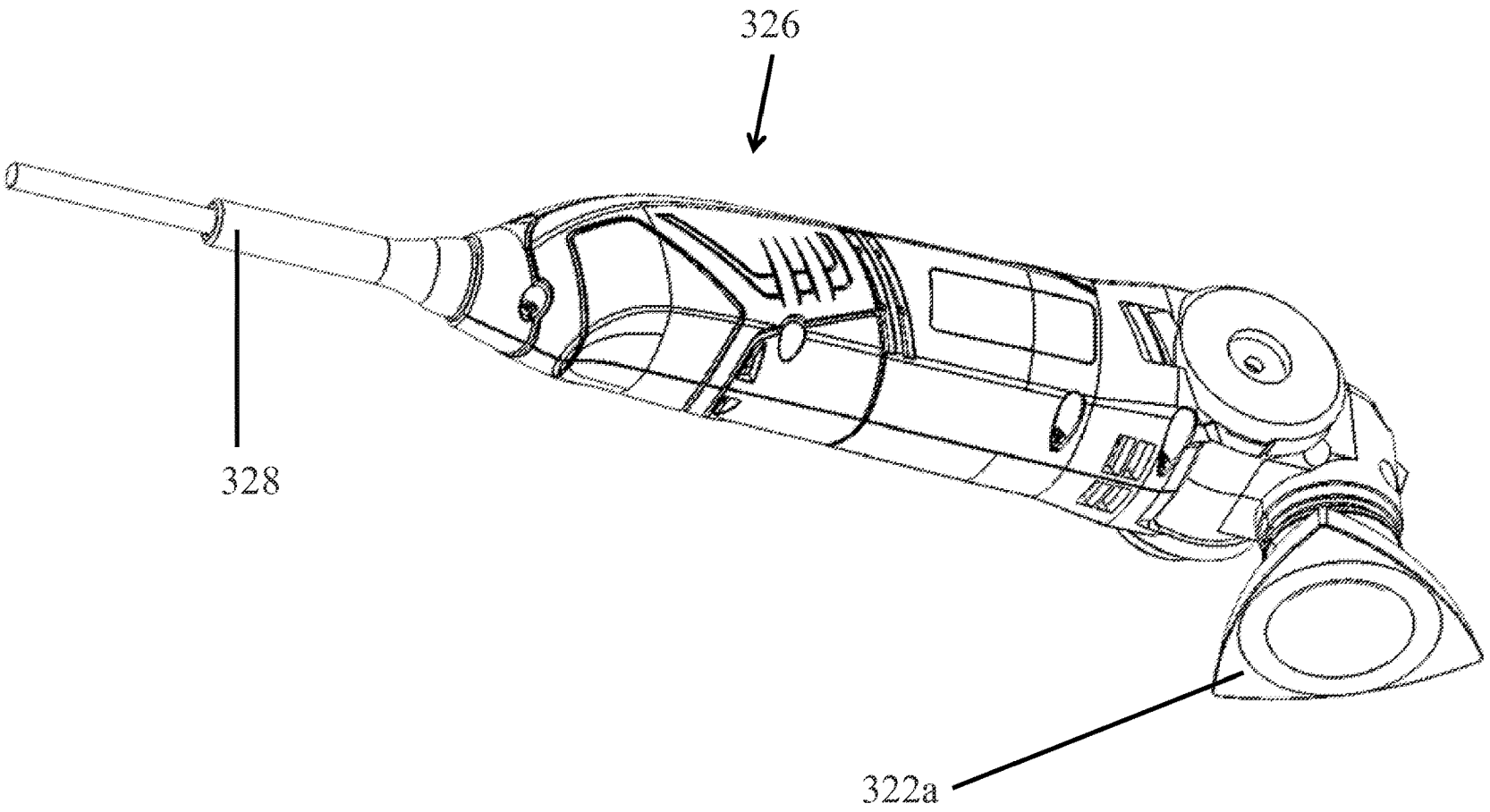
FIG. 20*b* is a bottom perspective view of the power tool of FIG. 10 having the sanding pad of FIG. 20*a*.
Figure 20C:
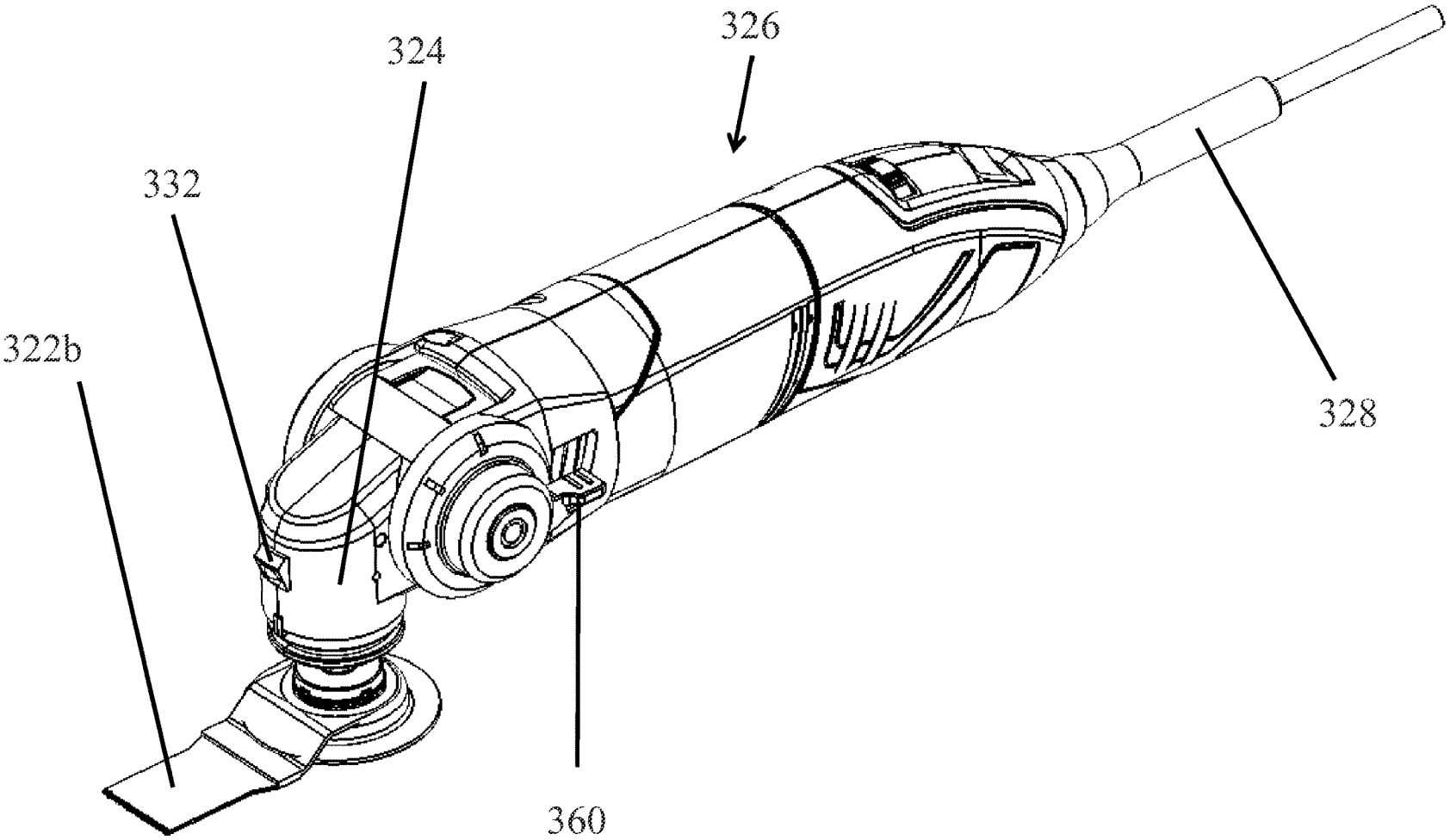
FIG. 20*c* is a top perspective view of the power tool of FIG. 10 having a blade cutter.
Figure 20D:
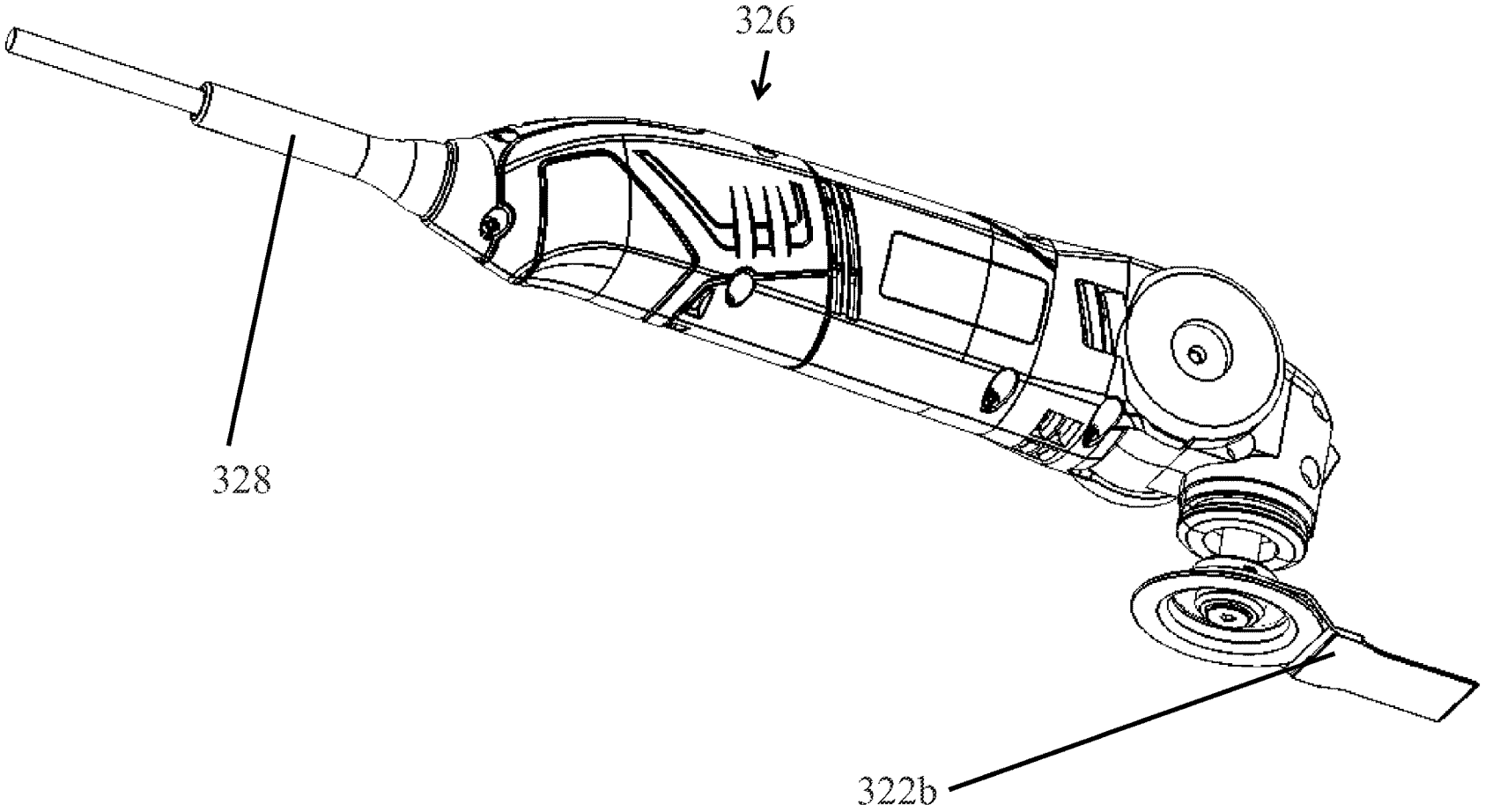
FIG. 20*d* is a bottom perspective view of the power tool of FIG. 10 having the blade cutter of FIG. 20*c*.

FIGS. 20*a*-20*b* illustrates another multi tool (e.g., the power tool 120 described above) equipped with a sanding pad 322*a* installed on a tool head 324. The multi tool shown in FIGS. 20*a*-20*b* runs on wired power supply, and there is a power cord 328 connected to the end of the main body 326, which is used to connect the electric circuit and electric motor in the power tool to an external electrical power source. A work light 332 is installed on the front panel of the tool head 324 to provide illumination at the workpiece during operation. FIGS. 20*c*-20*d* illustrate the same multi tool as FIGS. 20*a*-20*b*, with the only difference that the multi tool as shown in FIGS. 20*c*-20*d* is installed with a blade cutter 322*b*.

While the invention has been illustrated and described in detail in the drawings and foregoing description, the same is to be considered as illustrative and not restrictive in character, it being understood that only exemplary constructions have been shown and described and do not limit the scope of the invention in any manner. It can be appreciated that any of the features described herein may be used with any construction. The illustrative constructions are not exclusive of each other or of other constructions not recited herein. Accordingly, the invention also provides constructions that comprise combinations of one or more of the illustrative constructions described above. Modifications and variations of the invention as herein set forth can be made without departing from the spirit and scope thereof.

For example, although in the constructions mentioned above the tool accessory installed to the tool head is shown to be a bi-directional metal blade, those skilled in the art would realize that other types of tool accessories could also be used with the articulating head of the present invention. Such tool accessories include, but are not limited to, wood blade, coarse cut blade, carbide blade, circular saw scraper blade, flexible scraper blade, sanding pad, etc.

Also, the predetermined positions of the articulating head in the constructions described above are 0 degrees, 45 degrees and 90 degrees respectively. However, in other constructions it is also possible to add additional predetermined positions for the rotating head, such as 30 degrees and 60 degrees. In yet other constructions, the rotating head can be lockable continuously through a range of motion. It should be understood by a skilled person that choosing different predetermined positions for the articulating head according to the present invention is a design modification that becomes necessary when there is a practical need for such configuration.

Various features and advantages of the invention are set forth in the following claims.

What is claimed is:

1. An articulating power tool comprising:

a main body;

a base member including a first power transmission part configured to receive mechanical driving power from the main body;

an articulating member pivotably coupled to the base member about a pivot axis, the articulating member including a second power transmission part mechanically coupled to said first power transmission part; and a locking device coupled to the articulating member for locking an orientation of the articulating member with respect to the base member, the locking device including an actuation lever rotatable about the pivot axis of the articulating member between a free position and a lock position, a transitional locking member having a cam surface arranged coaxially about the pivot axis of the articulating member, and a biasing member urging the transitional locking member away from the articulating member and towards the actuation lever;

wherein the articulating member is configured to pivot about the pivot axis with respect to the base member in the free position, and wherein the articulating member is configured to be locked at one of a plurality of predetermined angles with respect to the base member in the lock position.

2. The articulating power tool of claim 1, wherein the cam surface is a first cam surface, and wherein the locking device further comprises:

an actuation locking member having a second cam surface, the actuation locking member coupled for rotation with the actuation lever;

wherein the first and second cam surfaces cooperate to displace the transitional locking member between the lock position and the free position as the actuation locking member rotates about the pivot axis with respect to the transitional locking member.

3. The articulating power tool of claim 2, wherein the transitional locking member is movable axially along the pivot axis with respect to the articulating member and fixed rotationally about the pivot axis with respect to the articulating member; wherein the transitional locking member is movable axially along the pivot axis into locking engagement with the articulating member in the lock position.

4. The articulating power tool of claim 3, wherein the transitional locking member includes a first plurality of teeth and the articulating member includes a head locking member having a second plurality of teeth, wherein the first and second pluralities of teeth are engaged with each other in the lock position to lock the articulating member with respect to the base member; wherein the first and second pluralities of teeth are disposed coaxially about the pivot axis, and wherein the first and second pluralities of teeth protrude axially with respect to the pivot axis into engagement with each other.

5. The articulating power tool of claim 1, wherein the biasing member includes a coil spring arranged coaxially with the pivot axis.

6. The articulating power tool of claim 2, wherein the transitional locking member, the actuation locking member, and the actuation lever are disposed coaxially about the pivot axis.

7. The articulating power tool of claim 1, wherein the second power transmission part is mechanically coupled to the first power transmission part via an intermediate transmission part, the intermediate transmission part capable of pivoting with respect to the first power transmission part together with the articulating member pivoting with respect to the base member; the intermediate transmission part transforming a first mechanical movement from said first power transmission part into a second mechanical movement to said second power transmission part; wherein the intermediate transmission part is configured to pivot with respect to the first power transmission part about the pivot axis.

8. The articulating power tool of claim 1, wherein the articulating member is hingedly connected to the base member at two side portions of the base member along the pivot axis.

9. The articulating power tool of claim 8, further comprising an intermediate transmission part operatively coupled between the first transmission part and the second transmission part, wherein a joint of the first power transmission part and the intermediate transmission part is arranged between the two side portions and wherein the pivot axis intersects the joint.

10. The articulating power tool of claim 9, wherein the first power transmission part further comprises an eccentric shaft and an eccentric bearing coupled to the eccentric shaft; the eccentric shaft capable of receiving a centric rotary motion from the main body of the power tool, and transforming the centric rotary motion into an eccentric rotary motion of the eccentric bearing; wherein the intermediate transmission part includes a forked member further comprising two prongs and a coupling member configured at an opposite end of the forked member to the prongs along a longitudinal direction of the forked member; ends of the prongs contacting opposite sides of the eccentric bearing at the joint whereby the forked member transfers the eccentric rotary motion of the eccentric bearing into oscillating motion of the coupling member.

11. The articulating power tool of claim 10, wherein the second power transmission part includes a tool shaft; the tool shaft coupled with the coupling member of the forked member such that the tool shaft is driven to oscillate by the oscillating motion of the coupling member.

12. The articulating power tool of claim 10, wherein the forked member is capable of pivoting with respect to the eccentric bearing at the joint of the prongs and the opposite sides of the eccentric bearing; the pivoting axis intersecting the opposite sides of the eccentric bearing.

13. The articulating power tool of claim 1, further comprising a dust extraction attachment rotatably mounted on the articulating member.

14. The articulating power tool of claim 13, wherein the dust extraction attachment further comprises a circular dust collecting part and an air outlet in air connection with the dust collecting part; wherein the air outlet is an adapter for an external suction device.

15. The articulating power tool of claim 13, wherein the dust extraction attachment further comprises a supporting arm; wherein a first end of the supporting arm is coupled to the dust collecting part and a second end of the supporting arm is rotatably fixed to the base member.

16. The articulating power tool of claim 1, wherein the locking device is configured to mesh with at least one of the articulating member or the base member in the lock position.

17. An articulating power tool comprising:

a main body;

a base member including a first power transmission part configured to receive mechanical driving power from the main body, an articulating member pivotably coupled to the base member about a pivot axis, the articulating member including a second power transmission part mechanically coupled to said first power transmission part; and a locking device coupled to the articulating member for locking an orientation of the articulating member with respect to the base member, the locking device including an actuation lever rotatable about the pivot axis of the articulating member between a free position and a lock position;

wherein the articulating member is configured to pivot about the pivot axis with respect to the base member in the free position, and wherein the articulating member is configured to be locked at one of a plurality of predetermined angles with respect to the base member in the lock position, and wherein the locking device includes at least one tooth configured to mesh with at least one of the articulating member or the base member in the lock position.

18. The articulating power tool of claim 17, wherein the locking device further comprises a cam surface, and wherein the locking device is configured to cam into and out of the lock position by way of the cam surface.

19. The articulating power tool of claim 17, wherein the locking device includes a transitional locking member operatively coupled to the actuation lever, wherein the transitional locking member is axially displaceable along the pivot axis into and out of the lock position in response to rotation of the actuation lever.

20. The articulating power tool of claim 17, wherein the second power transmission part is configured for rotational oscillation at an output of the articulating power tool.

21. The articulating power tool of claim 17, further comprising a forked member operatively coupled between the first power transmission part and the second power transmission part.

22. An articulating power tool comprising:

a main body;

a base member including a first power transmission part configured to receive mechanical driving power from the main body;

an articulating member pivotably coupled to the base member about a pivot axis, the articulating member including a second power transmission part mechanically coupled to said first power transmission part; and a locking device coupled to the articulating member for locking an orientation of the articulating member with respect to the base member, the locking device including:

an actuation lever rotatable about the pivot axis of the articulating member between a free position and a lock position, a transitional locking member having a first cam surface, and an actuation locking member having a second cam surface, the actuation locking member coupled for rotation with the actuation lever;

wherein the first and second cam surfaces cooperate to displace the transitional locking member between the lock position and the free position as the actuation locking member rotates about the pivot axis with respect to the transitional locking member; and wherein the articulating member is configured to pivot about the pivot axis with respect to the base member in the free position, and wherein the articulating member is configured to be locked at one of a plurality of predetermined angles with respect to the base member in the lock position.

23. The articulating power tool of claim 22, wherein the second power transmission part is mechanically coupled to the first power transmission part via an intermediate transmission part, the intermediate transmission part capable of pivoting with respect to the first power transmission part together with the articulating member pivoting with respect to the base member; the intermediate transmission part transforming a first mechanical movement from said first power transmission part into a second mechanical movement to said second power transmission part; wherein the intermediate transmission part is configured to pivot with respect to the first power transmission part about the pivot axis.

* * * * *